US010582730B2

(12) United States Patent
Braverman

(10) Patent No.: US 10,582,730 B2
(45) Date of Patent: Mar. 10, 2020

(54) BRASSIERE

(71) Applicant: Laurie Braverman, New York, NY (US)

(72) Inventor: Laurie Braverman, New York, NY (US)

( * ) Notice: Subject to any disclaimer, the term of this patent is extended or adjusted under 35 U.S.C. 154(b) by 985 days.

(21) Appl. No.: 14/295,714

(22) Filed: Jun. 4, 2014

(65) Prior Publication Data

US 2016/0029706 A1 Feb. 4, 2016

(51) Int. Cl.

| | |
|---|---|
| ***A41C 3/10*** | (2006.01) |
| ***A41C 3/00*** | (2006.01) |
| ***A41C 5/00*** | (2006.01) |
| ***A41C 3/14*** | (2006.01) |
| ***A41C 3/06*** | (2006.01) |

(52) U.S. Cl.

CPC ..... *A41C 3/10* (2013.01); *A41C 3/0007* (2013.01); *A41C 3/0092* (2013.01); *A41C 3/06* (2013.01); *A41C 5/00* (2013.01); *A41C 3/144* (2013.01)

(58) Field of Classification Search

CPC ..... A41C 3/0092; A41C 3/10; A41C 3/142; A41C 3/144; A41C 3/146; A41C 3/148; A41C 3/14; A41C 3/005

USPC ..... 450/55, 54, 56, 57

See application file for complete search history.

(56) References Cited

U.S. PATENT DOCUMENTS 2,041,066 A * 5/1936 Howard ..... A41C 3/144 2/237
2,052,707 A 9/1936 Haimoff
2,342,076 A * 2/1944 Herbener ..... A41C 3/144 450/56
2,563,241 A * 8/1951 Herbener ..... A41C 3/144 2/267
2,567,732 A 9/1951 Rosenthal
2,611,129 A * 9/1952 Copenhagen ..... A41C 3/144 2/267
2,673,981 A 4/1954 Popp
2,728,079 A 12/1955 Williams (Continued)

FOREIGN PATENT DOCUMENTS

RU 98734 10/2010

OTHER PUBLICATIONS

International Preliminary Report on Patentability in PCT Patent Application No. PCT/US2015/033734, dated Dec. 10, 2016.

(Continued)

*Primary Examiner* — Jameson D Collier
*Assistant Examiner* — Jocelyn Bravo
(74) *Attorney, Agent, or Firm* — Greenblum & Bernstein, P.L.C.

(57) ABSTRACT

A brassiere includes a first wing and a second wing, a closure including a first closure portion on a first end of the first wing, and a second closure portion on a first end of the second wing; a pair of cups including a first cup connected to the second end of the first wing, and a second cup connected to the second end of the second wing; each cup including an inner contour shaped with a first volume, and an outer contour having a cup and diameter size larger than the inner contour, and filling material between the inner contour and the outer contour a gore connected between the first cup and the second cup; and a pair of straps including a first strap connected to the first cup and the first wing, and a second strap connected to the second cup and the second wing.

19 Claims, 12 Drawing Sheets

INSIDE VIEW

(56) References Cited

U.S. PATENT DOCUMENTS 2,734,193 A 2/1956 Croxall
2,834,352 A * 5/1958 Ullian ..... A41C 3/10 450/57
2,899,961 A * 8/1959 Faron ..... A41C 3/10 450/41
3,021,845 A * 2/1962 Smith ..... A41C 3/10 450/39
3,221,747 A 12/1965 Blair
3,221,748 A * 12/1965 Glasser ..... A41C 3/10 450/56
3,814,107 A * 6/1974 Greenblatt ..... A41C 3/10 450/56
4,143,662 A * 3/1979 Fisher ..... A41C 3/10 450/53
4,519,137 A * 5/1985 O'Boyle ..... A41C 3/00 33/17 R
4,992,074 A * 2/1991 Diaz ..... A41C 3/065 2/267
5,480,429 A * 1/1996 Weber-Unger ..... A61F 2/52 2/267
5,485,855 A 1/1996 Shiraiwa et al.
6,101,630 A * 8/2000 Lee ..... A41C 3/0028 2/57
6,224,458 B1 * 5/2001 Chen ..... A41C 3/10 450/38
6,402,585 B1 * 6/2002 Gatto ..... A41C 3/10 450/53
6,431,945 B1 * 8/2002 Stephens ..... A41C 3/10 450/37
6,439,959 B1 * 8/2002 Magrone ..... A41C 3/0014 450/41
6,447,365 B1 * 9/2002 Powell ..... A41C 3/122 450/41
6,746,306 B2 6/2004 Brothers
6,953,380 B2 * 10/2005 Brothers ..... A41C 3/0007 450/41
6,966,815 B2 * 11/2005 Weinerth ..... A41C 3/10 450/39
7,309,275 B1 * 12/2007 Morales ..... A41C 3/02 450/38
7,377,833 B1 * 5/2008 Wanzenboeck ..... A41C 3/122 450/41
7,425,170 B1 9/2008 Herbert et al.
7,452,260 B2 * 11/2008 Redenius ..... A41C 3/0021 450/60
7,871,305 B2 1/2011 Cohen
8,075,367 B2 * 12/2011 Taylor ..... A41C 3/10 2/53
8,123,589 B2 2/2012 Chapman
8,167,678 B2 * 5/2012 Castellano ..... A41C 3/144 450/39
8,216,021 B1 * 7/2012 MacKinnon ..... A41C 3/144 450/54
8,221,189 B2 * 7/2012 Chen ..... A41C 3/065 450/54
8,568,196 B2 * 10/2013 Haworth ..... A41C 3/0021 450/60
8,727,830 B2 * 5/2014 Fleeton ..... A41C 3/105 2/DIG. 3
9,011,199 B2 * 4/2015 Yuasa ..... A41C 3/10 450/53
RE45,838 E * 1/2016 MacKinnon ..... A41C 3/144
9,386,808 B2 * 7/2016 Turlan-Van Der Hoeven ..... A41C 3/10
9,629,753 B2 * 4/2017 Golubovic ..... A61F 13/15
2001/0021620 A1 * 9/2001 DeMarco ..... A41C 3/0078 450/81
2003/0232571 A1 * 12/2003 Weinerth ..... A41C 3/10 450/41
2005/0020183 A1 * 1/2005 Falla ..... A41C 3/144 450/39
2005/0164602 A1 * 7/2005 Armstrong ..... A41C 3/0057 450/57
2007/0021035 A1 * 1/2007 Bugada ..... A41C 3/0014 450/39
2007/0289047 A1 * 12/2007 Fortner ..... A41C 3/144 2/268
2008/0176485 A1 * 7/2008 Linkon ..... A41C 3/10 450/57
2009/0191789 A1 * 7/2009 Knox ..... A41C 3/00 450/8
2009/0233524 A1 * 9/2009 Cohen ..... A41C 3/0028 450/56
2009/0239444 A1 * 9/2009 Perman ..... A41C 3/122 450/38
2009/0247047 A1 * 10/2009 Avalos-Dessner ..... A41C 3/10 450/52
2010/0015886 A1 * 1/2010 Waitz ..... A41C 3/10 450/39
2010/0022164 A1 * 1/2010 Taylor ..... A41C 3/10 450/41
2010/0041313 A1 * 2/2010 Castellano ..... A41C 3/144 450/39
2010/0048098 A1 * 2/2010 Rosario ..... A41C 3/0035 450/57
2010/0233936 A1 * 9/2010 Gransberry ..... A41C 3/144 450/57
2010/0273395 A1 * 10/2010 Castellano ..... A41C 3/144 450/39
2010/0317256 A1 * 12/2010 Zhang ..... A41C 5/005 450/38
2011/0287691 A1 * 11/2011 Hu ..... A41C 3/10 450/56
2012/0135667 A1 * 5/2012 Chan ..... A41C 3/0092 450/58
2012/0149278 A1 * 6/2012 Liu ..... A41C 3/144 450/57
2012/0156961 A1 * 6/2012 Mayer ..... A41C 3/144 450/55
2012/0184180 A1 * 7/2012 Hu ..... A41C 3/144 450/55
2013/0065485 A1 * 3/2013 Goodwin ..... A41C 3/10 450/41
2013/0095728 A1 * 4/2013 Crompton ..... A41C 3/0007 450/41
2014/0154947 A1 * 6/2014 Braverman ..... A41C 3/10 450/41
2014/0273738 A1 * 9/2014 Raven ..... A41C 3/144 450/57
2014/0302745 A1 * 10/2014 Golubovic ..... A61F 13/15 450/1
2015/0056890 A1 * 2/2015 Black ..... A41C 3/0057 450/86
2015/0087203 A1 * 3/2015 Turlan-Van Der Hoeven ..... A41C 3/10 450/93
2016/0081397 A1 * 3/2016 Gardner ..... A41C 3/0064 450/39
2016/0165964 A1 * 6/2016 West ..... A41C 3/0007 450/53
2016/0286879 A1 * 10/2016 Farmer ..... A41B 17/00
2017/0156413 A1 * 6/2017 Braverman ..... A41C 3/10
2017/0325517 A1 * 11/2017 Brownell ..... A41C 3/08

OTHER PUBLICATIONS

"Her Room" webpage, Jun. 28, 2012.
"Brassiere" Wikipedia webpage, Sep. 30, 2011.
"Brassiere Measurement" Wikipedia webpage, May 13, 2011.
"Brassiere Measurement" Wikipedia webpage, Mar. 2013.
"The Bra Book", pp. 24-25, 46-47, 49, 50, 55, 73-75, 189-192, 197-198, Nov. 2012.
"Eve's Apples" webpage, Jun. 16, 2012.
"Lula Lu" webpage, Aug. 5, 2008.
"Beauty Lies Beneath" webpage, Mar. 2013.
"How to Make a Bra" webpage, Jul. 3, 2012.

(56) References Cited

OTHER PUBLICATIONS

"Biofit Uplift, See How It Works", Sep. 2011.
"The Bra-makers Manual" vol. 1, Beverly Johnson, webpage, Jun. 28, 2012.
"The Bra-makers Manual" vol. 2, Beverly Johnson, webpage, Jun. 28, 2012.
"Bare necessities" webpage, Jun. 28, 2012.
"Book studies the history, underlying facts of bras", Chicago Tribune webpage, Jul. 26, 2011.
"Bustpoint Spacing", Her Room Website, Jun. 2012.
"Breast Separation It Matters", Tomina Blog, Oct. 2012.
"Classify Your Breasts", Tomina Blog, Mar. 2013.
"How to Tell If Your Bra Fits", About.com, Oct. 2012.
"6 Ways to Tell If Your Bra Fits", About.com, Oct. 2012.
"Partial Coverage Bra Fitting", Oct. 2012.
"Boosaurus Bra Fitting", Oct. 2012.
"Breast Shapes Invest in Your Chest", A Lingerie Blog, Oct. 31, 2012.
"A Few Words About Breasts" by Nora Ephron, Esquire, Jun. 2012.
"Mail on Line How a Bowl of Warm Water Can Help You Buy a Bra That Fits Better", Jul. 2012.
"Cleavage Enhancement", Wikipedia, Oct. 26, 2011.
"List of Brassiere Designs", Oct. 26, 2011.
"Eves Apple Custom Bra Fit Consultation", Jun. 2012.
"The Optometrist Attic Fitting and Measuring", Jul. 16, 2012.
"Bravo", New York Post, Jul. 25, 1999.
"What's worse than badly fitting shoes?", New York Times, Sep. 2, 2010.
"To sell lingerie, inhibitions, and much more, are falling", New York Times, Nov. 6, 2003.
"Dreaming of bras for the modern woman", New York Times, Nov. 28, 2005.
"As a gauge of social change, behold: the breast", New York Times, Nov. 28, 2005.
"Where minimal assets are a plus", New York Times, Sep. 2, 2010.
"Little Woman", UK website, Jun. 22, 2013.
WIPO Search Report PCT/US2013/073035, dated Mar. 13, 2014.
U.S. Appl. No. 13/839,566, filed Mar. 13, 2013 to L. Braverman.
Search Report and Written Opinion issued by PCT patent office in PCT Patent Application No. PCT/US2015/033734, dated Dec. 10, 2015.

* cited by examiner

INSIDE VIEW

OUTSIDE VIEW

INSIDE VIEW

OUTSIDE VIEW

OUTSIDE VIEW

INSIDE VIEW

OUTSIDE VIEW

INSIDE VIEW

FIG. 21
FIG.3
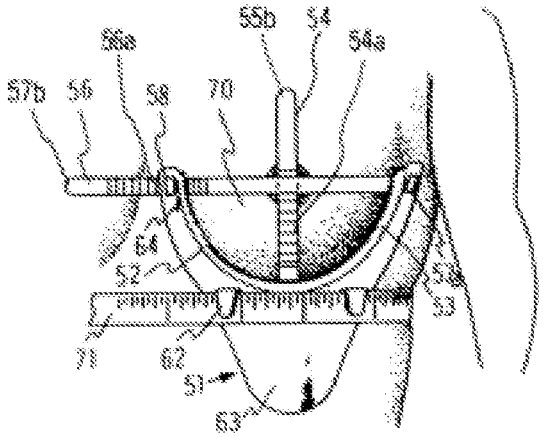
FIG.4
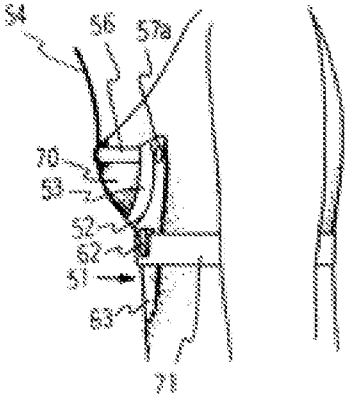

BRASSIERE

BACKGROUND OF THE INVENTION

1. Field of the Invention

The invention relates to the field of brassieres, particularly to a brassiere of the padded type.

2. Description of the Related Art

According to Wikipedia "brassiere measurement refers to determining what size of bra a woman wears and mass-producing bras that will fit most women. Bra sizes usually consist of a number, indicating a band size around the woman's torso, and one or more letters indicating the breast cup size. Bra cup sizes were invented in 1932 and band sizes became popular in the 1940s.

The term "cup" was not used to describe bras until 1916 when two patents were filed.

In October 1932, the S.H. Camp and Company were the first to measure cup size by the letters of the alphabet, A, B, C, and D, though the letters represented how pendulous the breasts were and not their volume.

To mass produce bras, manufacturers size their bras to a prototypical woman called a "fit model".

A fit model is used by an apparel company as the "ideal" body type for whom the bra is designed. The fit model is chosen on her body size and proportions with the goal of representing all of the people in the target market. Once the fit has been perfected on these models, the patterns are graded and the bra is made. The traditional bra cup is not shaped to conform to variations in the human female breast. In prior art, the cup of the bra angles upwardly and outwardly from an underwire (or wireless) attachment point, leaving little allowance for differences in breast shape, spacing and body type. Manufacturing a well fitting bra is a challenge since the garment is supposed to be form fitting but women's breasts can vary in volume, width, height, composition, shape and position on the chest. Manufacturers make standard bra sizes that provide a "close" fit however even a woman with accurate measurements can have a difficult time finding a correctly fitted bra. Manufacturers may size and design bras to different standards of an "ideal". The fit model is the determining factor of the fit of the bra. Even if a woman has the exact same measurements as the fit model the bra may not fit as current industry measurements don't account for breast and body variations".

In the study "Size Prediction For Plus Size Women's Intimate Apparel Using A 3-D Body Scanner" by K. Pandarum it says:

"Studies conducted by Keiser et al indicated that the current methods of creating sizes and analyzing garment fit are:

1) based on measurements of "one ideal customer embodied in a single fit model";
2) adjusted for additional sizes by using "grade rule from base pattern"; and
3) visually evaluated on the fit model and in "two dimensions" by comparing linear garment measurements to linear garment measurements.

Brown and Rice went further stating that the fit of the garment is dependent on five elements, namely the (1) Grain, (2) Set, (3) Line (4) Balance and (5) Ease. With Shin reporting that in the elevation of the proper fit of a bra, "tension", is replaced by "ease". The stretch material of the wing of the bra accommodates the "negative ease" estimated to be between 10 to 15 centimetres from the actual ribcage circumference. Hence the fabric properties and selection are also important criteria in the proper fitting of a bra".

"Sizing in Clothing Developing Effective Sizing Systems for Ready to Wear Clothing" Edited by S. P. Ashdown states:

The assumption that garment sizing replicates body sizing has channeled research in the direction of describing the human body and creating body sizing systems which are then transferred onto apparel to create garment sizing systems. Garment fit however, depends on the amount of ease added above and beyond the body measurements for comfort and style and these amounts are not necessarily equal for all sizes. In an ideal fit test scenario in order to refine a sizing system a garment pattern can be recreated for each size and fit tested and adjusted on a person that is representative of that body size group. Once the garment patterns are adjusted for all sizes, the garment sizing system including appropriate experimentally derived ease values will be apparent. Created in this way, the garment body-sizing system will not necessarily replicate the intersize intervals of the body sizing system it fits (Watkins 1995).

"Problems with garment fit may arise from the current industry practice of setting sizing systems namely sizing up and down the measurements of a garment perfectly fitted to a single person called a fit model, by applying the grades of a standard body sizing system. In this way the garment sizing system is set equal to the body sizing system and the garment is fitted to one individual only instead of to a group of subjects representative of a whole target population. Factors that influence garment fit in this scenario include the fit model, who essentially sets the starting point for the size scale and might not be representative of the target population and the body size grades, which might not be appropriate for the targeted population. Also, the assumption that garment grades equal body grades might be false, i.e. ease might be size dependent and therefore the comfort and or style/ease chosen may be inadequate across different sizes, etc. In such cases the only way to evaluate the original body sizing system is through indirect evaluation of the garment sizing system. A closely fitted style of garment manufactured in all sizes of the sizing system can be fit tested by a representative sample of the target population to evaluate how well it will provide garments that fit the population as a whole. Effectively what is being assessed is the garment sizing system but, since the ultimate goal of body sizing construction for apparel is to provide well fitted clothing, garment sizing evaluation is preferable. During that evaluation one is identifying that group of subjects whose bodies fit the created set of garments well.

In the optimization approach the persons left out of the system may have measurements closer to the average along the control dimensions but may have been excluded from the system because no combination of the dimensions used in the optimization was close enough to their body measurements as a set. This means that there will be some people who despite their expectations will not be able to find a garment that fits them well.

According to Wikipedia, "the morphologic variations in the size, shape, volume tissue density, pectoral locale, and spacing of the breasts determine their natural shape, appearance, and configuration upon the chest of a woman; yet such features do not indicate its mammary-gland composition (fat-to-milk-gland ratio), nor the potential for hormonal nursing an infant child. The size and the shape of the breasts are influenced by normal-life hormonal changes (thelarche, menstruation pregnancy, menopause) and medical conditions (e.g. virginal breast hypertrophy). The shape of the breasts is naturally determined by the support of the suspensory Cooper's ligaments the underlying muscle and bone structures of the chest, and the skin envelope. The suspensory ligaments sustain the breast from the clavicle (collarbone) and the clavico-pectoral fascia (collarbone and chest), by traversing and encompassing the fat and milk-gland tissues, the breast is positioned, affixed to, and supported upon the chest wall, while its shape is established and maintained by the skin envelope.

The base of each breast is attached to the chest by the deep fascia over the pectoralis major muscles. The space between the breast and the pectoralis major muscle is called the retro mammary space and gives mobility to the breast. Some breasts are mounted high upon the chest wall, are of rounded shape, and project almost horizontally from the chest, which features are common to girls and women in the early stages of the larchic development, the sprouting of the breasts. In the high-breast configuration, the dome-shaped and the cone-shaped breast is affixed to the chest at the base, and the weight is evenly distributed over the base area. In the low-breast configuration, a proportion of the breast weight is supported by the chest, against which rests the lower surface of the breast, thus is formed the inframammary fold (IMF). Because the base is deeply affixed to the chest, the weight of the breast is distributed over a greater area, and so reduces the weight-bearing strain upon the chest, shoulder, and back muscles that bear the weight of the bust.

The chest thoracic cavity progressively slopes outwards from the thoracic inlet (atop the breastbone and above to the lowest ribs that support the breasts. The inframammary fold, where the lower portion of the breast meets the chest, is an anatomic feature created by the adherence of the breast skin and the underlying connective tissues of the chest; the IMF is the lower-most extent of the anatomic breast. In the course of thelarche, some girls develop breasts the lower skin-envelope of which touches the chest below the IMF, and some girls do not; both breast anatomies are statistically normal morphologic variations of the size and shape of women's breasts".

In prior art, bras are manufactured based on a standard diameter measurement based on breast volume and a standard projection measurement based on the relationship between the underbust measurement and the overbust measurement and an around the body measurement. Based on these industry standard measurements, the choices the customer has in actual fit variation is limited.

The invention recognizes the deficiencies in prior art practices of designing from an idealized fit model and using a tight (fit to form) breast root measurement to determine cup size. Using a tight (fit to form) breast root measurement at the inframammary fold which is a standard method in the industry for proper cup design and engineering, and using a limited selection of standards in sizes, does not properly accommodate a large percentage of the female population. Prior art, does not accommodate many of the variations of body and breast shapes using the above standards. Many women fall outside the fit range of the "ideal" fit model. These women have limited options from which to choose.

To determine sizing, it is generally accepted in the industry to determine size as a function of the diaphragm dimension, the around the body chest dimension and the bust dimension. The accepted industry measurements include two basic around the body measurements, the diaphragm measurement which determines the enumerated brassiere size (which is taken around the body below the breasts) and the body chest dimension which is taken around the body along the high points (areola) of the breasts. In general, cup volume is determined by computing the bust size based upon the difference in measurement between the actual chest measurement and the bust measurement. For example, the following may be used: if the bust is less than 1 inch larger then than the chest, the cup size is AA; if the bust is 1 inch larger than the chest, the cup size is A; and if the bust is 2 inches larger than the chest, the cup size is B etc.

Breasts have a diameter measurement and a projection measurement-distance the breast tissue protrudes from your chest. When you select a cup size like a C or a D, you are making a breast projection measurement selection. The breast diameter measurement is pre-determined by the manufacturer and built into each band size. The breast diameter is a determination of volume and projection for a particular size. The diameter reflects a tight breast root trace of the breast tissue. So, changing your band size also changes your underwire (or wireless) diameter. Going from a 34C to a 36C takes you up one breast diameter measurement. Going from a 34C to a 36B keeps the same breast diameter measurement. This is why going up a band size means you also need to go down a cup size if you want to keep the same cup volume.

Manufacturers use the exact same underwire size in multiple band sizes. For example, the actual underwire used in a 36B is the exact same underwire used in a 34C, 32D and 30E. All of these bras have the same breast diameter; just different breast projection measurements in relation to the band size—but all have the same cup volume.

Accordingly, the prior art patents exhibit numerous disadvantages and problems for providing a correct fitting and correct looking brassiere.

In U.S. Pat. No. 7,425,170 to Victor Herbert, Stewart Chapman, describes the underwire of their invention. In the background of the invention it is stated: "brassieres are commonly worn by women under their clothing to support their breasts. A brassiere, more commonly known to consumers as a bra, typically includes cups to support the breasts and wing portions that attach to the cups and encircle the upper torso of the woman to hold the bra on the woman's body. Some bra designs also utilize an armature, or flexible wire under the cups, to provide additional support for the breasts. However, some underwire configurations can lead to pinching, digging, and other discomfort after the bra is fastened to the woman's body due in part to an underwire that is not specifically formed to fit the user's breast. Additionally, some underwire and wing configurations can lead to unattractive bulging of the cup when the bra is worn by the woman. It is thus desirable to provide an underwire bra design that is configured to minimize pinching and discomfort of the wearer, as well as provide a better fit and appearance when worn by a woman".

U.S. Pat. No. 5,485,855 to Tatsuya Kusakabe, Norinobu Shiraiwa discloses an instrument for measuring breast shape. The patent describes the differences in breasts and variations in measurements relied upon for bra design. "In the clothing such as a brassiere and the like which have cups for supporting the breasts, the size of the lower cup part is important. The volume of the lower cup part, which is determined from the sum of the horizontal length and the vertical length of the breast across the bottom area (verg's line (the circular arch underneath each of the breasts), should correspond to the solid size of the breast.

The upper cup part of the brassiere is generally sewn on or continuous to the lower cup part, and the brassiere design is relatively free with regard to a portion from the size of the over cup part to the chest part. Thus, if the lower cup part is fit to the breasts of the user, the upper cup part can easily be fit to the breast.

There are many types of the cup shape of the clothing, and the cups are not designated by the same standard. For example, in many types of the brassiere such as a type for fully supporting the breasts, a type for pushing the breast to the center of the human body, or a type for pulling up the breasts upwardly, the volume of the breasts will be changed by the function of the brassiere which is to be enhanced, so that the sizes of the cups such as the bottom area, vertical length and the horizontal length of the cup are changed.

In the brassiere, there are many types, for example, a full cup brassiere with underwire, three-fourth cup brassiere with underwire, one-half cup brassiere with underwire, full cup no underwire brassiere and so on. Accordingly, when the size of the lower cup part is decided, the cup size can also be decided. For deciding the size of the lower cup part, the sizes of the verg's line of the breast, the horizontal length and the vertical length of the breast are important. Even if the verg's lines of the breast are the same, the horizontal length of the breast as well as the vertical length of the breast may vary due to the differences in the volume of the breasts. For instance, a breast with a large volume has greater horizontal length, vertical length and sum of these lengths than a breast with a smaller volume, even if the verg's line of the breast are the same. Therefore, the cup size must be arranged in consideration of the sum of the horizontal and vertical lengths.

On the other hand, even if the breast shapes are different, the shapes of the cups can be the same as long as the verg's line of the breast and the sum of the vertical and horizontal lengths of the breast are identical. For instance, if a nipple is positioned in the center of the breast, the horizontal length of the breast across the nipple is smaller than that of the breast with its nipple positioned at the lower part of the breast and projected more forward the front of the former breast; the length between the nipple and the verg's line of the breast, on the other hand, is larger than that of the latter breast. However, if the latter breast is moved up, the nipple is shifted upward, thus increasing the vertical length, lowering the height of the breast and reducing the horizontal length. In other words, the shape of the latter breast becomes identical to that of the former breast.

If a person whose verg's line of the breast is larger, but the breasts are relatively flat has the same value of the sum of the horizontal length and the vertical length of breast as that of a person whose verg's line of the breast is smaller than that of the former, but the breast is more protruded, they have respectively different verg's lines of the breast. Thus, they choose different cup sizes.

In case of actually selecting the cup sizes, the design of the cup is a little changed responding to the kinds of the cups, such as full cup, three-fourth cup, one-half cup, and the like.

FIGS. 3 and 4 of U.S. Pat. No. 5,485,855 are depicted in FIG. 21 of the present specification.

As shown in FIGS. 1 to 4, the instrument for measuring breast shape of the first embodiment comprises a base member 51, a vertical tape measure 54 and a horizontal tape measure 56. The base member 51 has a substantially half-circular edge part 52 which is to be put along the base line of a breast of a female body. Furthermore, the base member 51 has a breast supporting guide 53 provided along the substantially half-circular edge part 52 which protrudes like a visor. An end 55*a* of the vertical tape measure 54 is fixed on the base member 51 in the vicinity of the lowest position 60 of the half-circular edge part 52. The lowest position 60 corresponds to the lowest position of the verg's line of the breast. The verg's line is the circular arc under beneath of each breast. The vertical tape measure 54 is to be used for measuring the vertical length of the breast between the nipple and the lowest position of the verg's line of the breast (hereinafter abbreviated as "vertical length of the breast"). An end 57*a* of the horizontal tape measure 56 is fixed on the base member 51 in the vicinity of the first highest position 61 of the base member 51. The first highest position 61 corresponds to the highest position of the verg's line of the breast at the side of the human body. The horizontal tape measure 56 is to be used for measuring the horizontal length of the breast across the nipple (herein after abbreviated as "horizontal length of the breast"). A slit 58 is provided on the base member 51 in the vicinity of the second highest position 59 of the base member 51. The second highest position 59 corresponds to the highest position of the verg's line of the breast in the vicinity of the center of the bust of the female body. A free end 57*b* of the horizontal tape measure 56 is to be put in the slit 58. A pair of guide hooks 62 are provided on the base member 51 at positions below the breast supporting guide 53. In this embodiment, each guide hook 62 has a hook shape by which the instrument for measuring the breast shape is to be hooked on such as a string or a tape. The base member 51 further has a holder 63 by which the instrument is manually handled. A mark 64 is provided on the base member 51 in the vicinity of the second highest position 59 or the slit 58 for showing the position which is to be put on the center of the bust of the female body.

While it is not necessarily always the case, generally the length of a first member of the substantially half-circular edge part 52, which is from the lowest position 60 to the first highest position 61, is a little longer than that of a second member, which is from the lowest position 60 to the second highest position 59. The curvature of the first member is generally larger than that of the second member. Thus, instruments intended for use with the right breast or the left breast can be prepared, and the mark 64 is provided on the base member 51 to distinguish between the instruments for the right breast and for the left breast. For example, the instrument shown in FIG. 1 is for the left breast, since the mark 64 is shown in the left hand in the figure.

As shown in FIGS. 3 and 4, the instrument is put on the breast 70 of a female body. In this case, the guide hooks 62 of the base member 51 are hooked on a tape measure 71. The vertical and horizontal tape measures 54 and 56 respectively have graduations 54*a* and 56*a*. Units of the graduations 54*a* and 56*a* can be freely graduated. The graduations 54*a* and 56*a* graduated by an original unit such as A, B, C . . . , and the like can be acceptable, as long as they can measure the length. As is obvious from FIG. 4, it is preferable that the base member 51 has a shape in each section along the curve of the female body".

The teaching of U.S. Pat. No. 5,485,855 above describes the measurement for the circular arch underneath the breasts ("verg's line) as the determining factor of the cup size and shows there are many variables to breast measurement and related bra sizing, bra design and engineering that affects the proper measurement and fit of a bra.

According to Foundations Revealed: "In the industry a single "core size" block is "graded" (adjusted) to produce the other sizes in the range. The bra block is based on the assumption of an aesthetic optimum shape, a wire that is principally semicircular, a uniform diameter increment between wire diameters and a uniform volume increment between wire diameters. Underwires are designed to have some spring. Made out of heavy gauge wire, sheet metal or plastic, they splay or spread wider once a bra is put on and fastened. Then they return to their original shape when the bra is taken off. This springing or splay gives additional support to your breasts. If your breasts are wider than the splayed diameter of the underwire, over time the pressure and weight of your breasts can cause an underwire to break in half. Wire breakage can also occur if your band size is too small and thus over-splaying the underwires.

Breasts have a natural "crease line" (inframammary fold) where the underwire should fit comfortably against the ribcage. The diameter of the underwire is too small if the underarm end is poking breast tissue, or catches the arm as it moves forward. The diameter of the underwire is too large if the underarm end is poking into the armpit. The best underwire is one that encircles the breast, giving a more rounded and defined look. Women short in stature usually find that underwires poke them under their arms. An instant solution is to select demi cup bras—the wires are shorter and thus will not poke.

Cups give a hemi-spherical shape to breasts and underwires give shape to cup".

In the study entitled "Breast Sizing and Development of 3D Seamless Bra" Zheng Rong teaches:

"The global average radius of curvature was re-defined for "outer breast under curvature", "inner breast under curvature", and "under breast curvature" according to 15 key points around the breast bottom line in the current study. Point 1 is the outer-most point at the intersection of the cross-section through bust point and the breast root curve, whereas point 15 is the inner-most point at the crossing. Point 7 is the lower-most point of the breast bottom line located at the vertical-section through bust point. Then the outer breast under curve was divided into 6 equal portions between point 1 and point 7, whilst the inner breast under curve was segmented into 8 equal fractions from point 7 to point 15. Subsequently, the three global average radii of curvatures were measured based on outer-most point (point 1), point 4, lower-most point (point 7), point 11 and inner-most point The global average radius of curvature was used to characterize the breast bottom line. In 2D, the radius of curvature at a point is defined as the radius of the kissing circle that is tangential to the curve at that point. As discussed by Lee et al. (2004), the magnitude of the radius and the direction of circles varied greatly when utilizing the radius of curvature to analyze the breast root curve. "Global average radius of curvature" was therefore suggested as an evaluating parameter and was defined as the radius of the circle passing through three non collinear points.

Bra cup design is necessarily related to the breast shape. It is very important to measure the volume of whole body, upper torso, chest area and breast for evaluation of the breast shape and the whole body shape.

The breast volume is a very essential dimension related to bra design. Although the volume of a breast can be visualized using the 3D body scan data, it is very difficult to obtain accurate natural breast volumes because the borderline of the breast is not clear enough to be defined separately from the body surface. Medical research studies have investigated breast volume measurements for asymmetry assessment or breast surgery. In contrast, there is limited information relevant to the investigation of the 3D breast shape in the apparel industry. Moreover, many previous studies ignored the curved character of the 3D breast base. Most of the studies assume that the breast base is a circle and the breast bulk is a cone (Lee et al., 2004). D127 Global average radius of curvature of the under breast curve: the radius of the circle passing through outer-most point (point 1), lower-most point (point 7) and inner-most point (point 15). D128 Global average radius of curvature of outer breast under curve: the radius of the circle passing through outer-most point (point 1), point 4 and lower-most point (point 7). D129 Global average radius of curvature of inner breast under curve: the radius of the circle passing through lower-most point (point 7), point 11 and inner-most point (point 15)".

In Foundations Revealed "How to Make a Bra" it is taught "to take a breast root trace with a flexicurve, you have to make sure the flexicurve (measuring device) is up against the point around where your breast tissue joins the chest wall. This is the same point around the breast where the underwire of a correctly fitting bra should sit, not on the breast tissue (pain) and not away from the breast (poor fit)".

It is instructed in the industry to fit underwires, the same underwires are used for the cups of sizes 36A, 34B, 32C, 30D etc. . . . so those cups have the same volume. The reference numbers of underwire sizes are based on a B cup bra, for example underwire size 32 is for 32B cup (and 34A, 30C . . . ). An underwire size 30 width has a curvature diameter of 3-inch ⅚≈9.7 cm and this diameter increases by ⅓ inch≈0.847 cm by size. The table below shows volume calculations for some cups that can be found in a ready-to-wear large size shop.

| Underwire size | Bra size (US system) | Bra size K system) | Cup diameter | Volume of one cup | Weight of both breasts |
|---|---|---|---|---|---|
| 30 | 32A 30B 28C | 32A 30B 28C | 9.7 cm (3 in 5/6) | 240 cc (0.51 US pt) | 0.43 kg (0.95 lb) |
| 32 | 34A 32B 30C 28D | 34A 32B 30C 28D | 10.6 cm (4 in 1/6) | 310 cc (0.66 US pt) | 0.56 kg (1.21b) |
| 34 | 36A 34B 32C 30D 28E | 36A 34B 32C 30D 28DD | 11.4 cm (4 in 1/2) | 390 cc (0.82 US pt) | 0.70 kg (1.51b) |
| 36 | 38A 36B 34C 32D 30E 28F | 38A 36B 34C 32D 30DD 28E | 12.3 cm (4 in 5/6) | 480 cc (1.0 US pt) | 0.86 kg (1.91b) |
| 38 | 40A 38B 36C 34D 32E 30F 28G | 40A 38B 36C 34D 32DD 30E 28F | 13.1 cm (5 in 1/6) | 590 cc (1.2 US pt) | 1.1 kg (2.41b) |
| 40 | 42A 40B 38C 36D 34E 32F 30G 28H | 42A 40B 38C 36D 34DD 32E 30F 28FF | 14.0 cm (5 in 1/2) | 710 cc (1.5 US pt) | 1.3 kg (2.91b) |
| 42 | 44A 42B 40C 38D 36E 34F 32G 30H 28I | 44A 42B 40C 38D 36DD 34E 32F 30FF 28G | 14.8 cm (5 in 5/6) | 850 cc (1.8 US pt) | 1.5 kg (3.3 lb) |
| 44 | 44B 42C 40D 38E 36F 34G 32H 30I 28J | 44B 42C 40D 38DD 36E 34F 32FF 30G 28GG | 15.7 cm (6 in 1/6) | 1,000 cc (2.1 US pt) | 1.8 kg (4.01b) |

-continued

| Underwire size | Bra size (US system) | Bra size K system) | Cup diameter | Volume of one cup | Weight of both breasts |
|---|---|---|---|---|---|
| 46 | 44C 42D 40E 38F 36G 34H 32I 30J 28K | 44C 42D 40DD 38E 36F 34FF 32G 30GG 28H | 16.5 cm (6 in 1/2) | 1,180 cc (2.5 US pt) | 2.1 kg (4.61b) |
| 48 | 44D 42E 40F 38G 36H 34I 32J 30K 28L | 44D 42DD 40E 38F 36FF 34G 32GG 30H 28HH | 17.4 cm (6 in 5/6) | 1,370 cc (2.9 US pt) | 2.5 kg (5.51b) |
| 50 | 44E 42F 40G 38H 36I 34J 32K 30L 28M | 44DD 42E 40F 38FF 36G 34GG 32H 30HH 28J | 18.2 cm (7 in 1/6) | 1,580 cc (3.3 US pt) | 2.8 kg (6.21b) |
| 52 | 44F 42G 40H 38I 36J 34K 32L 30M 28N | 44E 42F 40FF 38G 36GG 34H 32HH 30J 28JJ | 19.0 cm (7 in 1/2) | 1,810 cc (3.8 US pt) | 3.3 kg (7.3 lb) |
| 54 | 44G 42H 40I 38J 36K 34L 32M 30N 28O | 44F 42FF 40G 38GG 36H 34HH 32J 30JJ 28K | 19.9 cm (7 in 5/6) | 2,060 cc (4.4 US pt) | 3.7 kg (8.21b) |
| 56 | 44H 42I 40J 38K 36L 34M 32N 30O 28P | 44FF 42G 40GG 38H 36HH 34J 32JJ 30K 28KK | 20.7 cm (8 in 1/6) | 2,340 cc (4.9 US pt) | 4.2 kg (9.3 lb) |
| 58 | 44I 42J 40K 38L 36M 34N 32O 30P | 44G 42GG 40H 38HH 36J 34JJ 32K 30KK | 21.6 cm (8 in 1/2) | 2,640 cc (5.6 US pt) | 4.8 kg (11 lb) |
| 60 | 44J 42K 40L 38M 36N 34O 32P | 44GG 42H 40HH 38J 36JJ 34K 32KK | 22.4 cm (8 in 5/6) | 3,000 cc (6.3 US pt) | 5.3 kg (12 lb) |

The underwire defines your breast's diameter, a cup size defines your breast's projection or cup depth. Cup sizing is alphabetical—A, B, C, D etc.

In Pattern School, it is taught "the first step in determining your bra size, is your band size. Cup size is estimated by subtracting the under bust (band) measurement from the bust measurement and comparing the result to the table below. Each cup has a fit range of 2.5 cm. Again this table is suited to Australian bras only. International countries use different values to achieve the same task. Be careful when ordering 'equivalent' bras from overseas because if they use inches then the larger sizes are not actually equivalent thanks to 1" being 2.54 cm and not 2.5 cm!

| Bust-Underbust | Cup Size |
|---|---|
| 6.5-8 cm | AA cup |
| 8-10.5 cm | A cup |
| 10.5-13 cm | B cup |
| 13-15.5 cm | C cup |
| 15.5-18 cm | D cup |
| 18-20.5 cm | DD cup |
| 20.5-23 cm | E cup |

As far as making patterns goes, the next thing to consider are the underwires. For a single cup size you can get a half coverage wire, a full coverage wire and even an extra long wire. Their shapes may vary a little but for a single manufacturer they just tend to change length rather than change arch diameter.

Most wire manufacturers do follow the 1" increment system meaning you will have one wire that suits several different cup sizes. For example, an 8D uses the same wire as a 10C or a 12B or 14A.

| Similar Wires |
|---|
| 10A, 8B |
| 12A, 10B, 8C |
| 14A, 12B, 10C, 8D |

-continued

| Similar Wires |
|---|
| 16A, 14B, 12C, 10D, 8DD |
| 18A, 16B, 14C, 12D, 10DD |
| 18B, 16C, 14D, 12DD, 10E |
| 20B, 18C, 16D, 14DD, 12E |

There is a great amount of debate in which purists say manufacturers should create bras to fit dozens of different shaped breasts and not just volumes. As it is there are several cups for each band size, and if we went to several shapes for each of those cup volumes for each band, the sheer logistics would spiral into an economic and practical impossibility.

The breast can change shape reasonably well for its volume and the amount of discomfort usually increases with the degree it's distorted.

The 'aesthetic optimum' consists of a lower quarter spheroid and a slightly elongate upper quarter spheroid. If your breast doesn't fit this shape, it means you end up looking for a bra cup to suit your breast volume which will have a wire that doesn't properly fit the natural curve of your breast. While there is some variation among manufacturers you will always be limited by the commercially viable standard sizes".

In Foundations Revealed, Mark Garbarcyk discusses the problem with bra grading in industry. "When we want to change the size of a bra pattern/block we could draft a new block for the new size, but in the industry a single "core size" block is "graded" (adjusted) to produce the other sizes in the range.

Take, as an example, the British bra size system. There are 16 cup sizes, AA-A-B-C-D-DD-E-F-FF-G-GG-H-HH-J-K-L, and 6 band sizes from 30"-40". That makes 96 size options. Multiply that by 2 colourways (ie making white and black bras), and you and your company potentially have 192 different bras to make!

BUT what if you could use parts of one size bra in a different size bra? You can! Welcome to the world of bra CROSS GRADING. If you take the cups and the cradle/ underwires of a 34B bra and shorten the wings by the right amount, you have a 32C bra! Likewise, if you lengthen the wings on the cups and the cradle/underwires of a 34B bra by the right amount you will have a 36A bra! The same goes for other Cup/cradle sizes: —the cups/cradle of a 38D bra are the same size cups/cradle as a 40C bra, and 36DD bra and a 34E bra, and so on and so on. The table below shows cross grading using EN 13402 standard cup lettering.

| | | | | | | |
|---|---|---|---|---|---|---|
| Same cups and cradle | 30A | 32AA | 34AAA | | | |
| Same cups and cradle | 30B | 32A | 34AA | | | |
| Same cups and cradle | 30C | 32B | 34A | 36AA | | |
| Same cups and cradle | 30D | 32C | 34B | 36A | | |
| Same cups and cradle | 30E | 32D | 34C | 36B | 38A | |
| Same cups and cradle | 30F | 32E | 34D | 36C | 38B | 40A |
| Same cups and cradle | 30G | 32F | 34E | 36D | 38C | 40B |
| Same cups and cradle | 30H | 32G | 34F | 36E | 38D | 40C |
| Same cups and cradle | 30J | 32H | 34G | 36F | 38E | 40D |
| Same cups and cradle | 30K | 32J | 34H | 36G | 38F | 40E |

This cross grading system is also used for bra underwires: the underwires that are used in a 34B bra can also be used in a 36A bra, and so on.

The antiquated way in which women are measured for a bra is far from satisfactory, as it does not take into account the volume of the individual breasts and the variations in back size. For UK sizing, measure in inches around the chest just under the breasts, then add 5" if the measurement is an odd number or add 4" if the measurement is an even number. This is your "Band size"—30, 32, 34, 36 and so on.

Now measure around the bust at its fullest part and take the band measurement (+5 or +4) away from this measurement. The difference—1", 2", 3", 4"—indicates your cup size.

EXAMPLE

29"+5"=34" band size 34 back size and 35 full bust is a +1" difference=B cup

Think about this measurement method applied to two body shape extremes.

A woman who measures 29.5 inches around her ribcage and 35.5 inches around her overbust, but has a narrow back and full breasts.

A woman who measures 29.5 inches around her ribcage and 35.5 inches around her overbust, but she has a muscular, wide back and small breasts.

Using the traditional measuring method, both of these women would be offered the same size bra, but they have significantly different body shapes".

According to Wikipedia "bras are one of the most complex pieces of apparel. There are lots of different styles, and each style has a dozen different sizes, and within that there are a lot of colors. Furthermore, there is a lot of product engineering. You've got hooks, you've got straps, there are usually two parts to every cup, and each requires a heavy amount of sewing. It is very component intensive. From 60-70% of bras sold in the United Kingdom and the United States use underwire in the cup. The underwire is made of metal, plastic, or resin. Underwire is built into the bra around the perimeter of the cup where it attaches to the band, increasing the rigidity of the bra. The underwire improves support, lift and separation. Wirefree or softcup bras support breasts using additional seaming and internal reinforcement. Some types of bras like T-shirt bras utilize molded cups that eliminate bra seams and hide the woman's nipples. Others use padding or shaping materials to enhance bust size or cleavage.

There is an increasingly wide range of brassiere styles available, designed to match different body types, situations, and outer wear. The degree of shaping and coverage of the breasts varies between styles, as do functionality, fashion, fit, fabric, and color. Common types include backless, balconette, convertible, shelf, full cup, demi-cup, minimizing, padded, plunge, posture, push-up, racerback, sheer, strapless, t-shirt, underwire, unlined, soft cup, and sports bra. Many designs combine one or more of these styles. Bras are built into some garments like camisoles, single-piece swimsuits, and tank tops, eliminating the need to wear a separate bra.

There is also a wide range of body shapes and breast variations. A woman's breast tissue affects the way a bra fits. Full, semi-full, shallow and deflated are some upper breast shapes. Self-supporting, semi supported, settled and pendulous are some breast positions. Conical, thin, omega are some breast shapes. Touching, separated, splayed, narrow set and wide set are some breast positions".

Each of these breast variations are variations from an "ideal" fit model the bras were originally designed to have a "tight to form" fit.

According to Her Room, "when selecting a bra, it is important to know that a cup size on one band size is not equal to the same cup size on another band size. When a manufacturer grades his patterns to create different sizes for a bra style, he moves the bust points slightly wider with each cup size increase. B cup bust points are ½" farther apart than A cups. Bust points get ¼" farther apart between B, C, and D cups, and ⅛" farther apart with larger cup sizes.

An element of the proper fitting bra is the center panel, or gore. It is best if the center panel between the cups sits firmly against your chest".

In order to put some order into a product that has so many variations, the industry devised a sizing system to organize and categorize bras for fit, and manufacturing purposes. The system is based off of measurements of an original fit model and the variations in sizes (cross grading and sister sizes) are based off of that body type. If your body is not a variation of that "ideal" it will be difficult to find a comfortable bra. Bras are designed to fit tight to form and the engineering dynamics only work properly when all of the components are in sync. One variation can throw the engineering off and compromise the comfort of the bra.

It is taught with sister sizing if a 34C cup is too tight, the customer should try a 32D. The underwire (or cup size) is the same for both but the wings, and gore spacing might have been adjusted for the D cup. This means the placement on the body may not work even though the diameter of the cup is the same.

A C cup has a projection of 3" from the body and a D cup has a 4" projection from the body. Sister sizing is a manufacturing solution, more than a real alternative solution based on actual consumer differences. There are so many variations in body types, breast sizes, shapes, and combinations, it is impossible to properly accommodate an entire human female population based on standardizing the band and diameter combinations (ie a 2" bust on a 34" band (measured according to industry) equals a (34B) which is a 4.5 inch cup diameter and a 2" cup projection).

For underwire bras, according to Her Room website, "each band size has a pre-determined breast diameter built into it in the form of an underwire. Changing your band size can change the underwire diameter. It is also a fact that the same size underwire is used in different cup sizes-the underwire in a 36C is the same underwire used in a 34D and a 38B cup size. Thus, when you go up a band size and down a cup size, you will have the same fitting cup diameter (the same wire will be used) but a larger band. The diameter increase between standard underwire sizes is approximately ⅜". A standard underwire's length increase between sizes is approximately ⅝".

According to Lula Lu, "as the band size goes up, so does the cup size due to how bra cups are graded. For example, the 36AA cup is larger than a 34AA cup and a 34AA cup is larger than a 32AA cup. Additionally, manufacturers normally use a B or C cup for their bra designs and an A cup is usually scaled down from either the B or C cup used in the designs. Thus, the A cup may not be a true A cup and can result in a poor fit for smaller cup women".

According to How To Make a Bra, by Mark Garbarczyk, "when a designer produces a new bra, the prototype is made to a core size. This prototype is then "graded" (enlarged or reduced) to produce the other sizes. For size/band grading, the standard step increase in band size is 2", which takes a 34B to a 36A, for example. The underband will increase by 2", a quarter of that increase must be placed in each half cradle and wing. For cup grading, to get from 34B to 34C, for example, the underband length remains the same, the cradle must increase to provide the larger cup size, but the wing must get smaller to maintain the underband length, and the cup section is graded one size larger. The grading principles used currently in the industry are as follows. Cup Grading: to increase the cup volume, the cradle of the bra must also increase to accommodate the increase in cup size and the wing must be reduced to maintain the band size. Band Grading: to increase the size of the band, but maintain the cup/cradle size, combined with cup grading. Cross Grading: to use the cups and cradle of one size as the cups and cradle of another size bra".

According to Wikipedia, "bra sizes consisting of a number indicating the band size and a letter indicating the cup size became popular by the 1940's. The shape, size, symmetry, and spacing of women's breasts vary, the breasts may have been augmented, the breasts may be tubular in shape, or may sag. Manufacturing standards and sizes vary. All of which contribute to poorly fitting bras".

Standards for bra sizing in the United States and the world are as described in the following text and charts.

Bra Standards (The Bra Book): Figuring out proper cup size is not easy. It is calculated in relation to band size. The size of an A cup, i.e., the volume an A cup holds, changes depending on the band size. An A cup on a 32 band is not the same as an A cup on a 34 band, and so on. Just because a B is thought to be smaller than a C does not mean it actually is. A B cup is just smaller than a C on the same band size. The snugger band size decreases the width and depth of the cup which means the 34C, while smaller than the 36C, actually holds the same volume of breast tissue as the 36B. A 38A compared to a 34A, the cup will be obviously bigger. But if you compare a 38A with a 34D, the cups will be much closer in size.

Step 1: Band Size: First wrap the tape measure around the ribcage just below the bust and take the measurement. Since bra band sizes are even numbers, round up to the nearest even number. For example if the measure is 31 inches, round up to 32. The most common way of fitting advises adding 4 inches to this number. Some fitters advise to add only 2 inches to their rounded up ribcage measurement. So if the measure is 30 inches, the wearer is likely a 32 band. Some fitting methods combine these two, advising that if the ribcage measurement is 32 or below, then add 4 inches and if it's 34 or above add only 2 inches. Still other fitters will advise not to add any additional inches at all, which does work for some women.

Step 2: Cup Size: Wrap the tape measure around the fullest part of the bust. Then subtract the band size from this number and use the difference in inches to calculate the cup size using the chart. For example, if the bust measurement is an inch larger than the band size, the cup size will most likely be an A. If the bust measurement is two inches larger than the band size, the cup size will most likely be a B.

CHART 1

| Difference: Bust measurement Minus band size | U.S. Cup Size |
|---|---|
| Less than 1" | AA |
| 1" | A |
| 2" | B |
| 3" | C |
| 4" | D |
| 5" | DD/E |
| 6" | DDD/F |
| 7" | G |
| 7.5" | GG |
| 8" | G, H |
| 9" | H, I |
| 10" | H, I, J |
| 11" | HH |
| 11.5"-13" | I |
| 13"-15.5" | J |
| 15.5"-17" | K, JJ |

CHART 2

International Sizing: Bra-Band Sizing

| USA | UK | EURO | French | Italian | Australian |
|---|---|---|---|---|---|
| 28 | 28 | | | | |
| 30 | 30 | — | | | |
| 32 | 32 | 70 | 85 | 1 | 10 |
| 34 | 34 | 75 | 90 | 2 | 12 |
| 36 | 36 | 80 | 95 | 3 | 14 |
| 38 | 38 | 85 | 100 | 4 | 16 |
| 40 | 40 | 90 | 105 | 5 | 18 |
| 42 | 42 | | | | |
| 44 | 44 | | | | |
| 46 | 46 | | | | |
| 48 | 48 | | | | |
| 50 | 50 | | | | |
| 52 | 52 | | | | |
| 54 | 54 | | | | |
| 56 | 56 | | | | |
| ⋮ | ⋮ | ⋮ | ⋮ | ⋮ | ⋮ |

CHART 3

International Sizing: Bra-Band Sizing

| USA | UK | EURO | French | Italian | Australian |
|---|---|---|---|---|---|
| AA | AA | AA | AA | | |
| A | A | A | A | A | A |
| B | B | B | B | B or none | B |
| C | C | C | C | C | C |
| D | D | D | D | D | D |
| DD/E | DD | E | E | DD | DD |
| DDD/F | E | F | F | E | E |
| G | FF | | | F | F |
| H | FF | | | | FF |
| I | G | | | | G |

CHART 3-continued

| International Sizing: Bra-Band Sizing | | | | | |
|---|---|---|---|---|---|
| USA | UK | EURO | French | Italian | Australian |
| J | GG | | | | GG |
| K | H | | | | HH |
| L | HH | | | | |
| M | J | | | | J |
| N | JJ | | | | JJ |

| The website Beauty Lies Beneath includes the following European size chart: | | | | | | | |
|---|---|---|---|---|---|---|---|
| Cm 2 | IT | EU | FR | UK | US | CUP B | CUP C |
| 63-67 | 1 | 65 | 80 | 30 | xs | 79-81 | 81-83 |
| 68-72 | 2 | 70 | 85 | 32 | s | 84-86 | 86-8 |
| 73-77 | 3 | 75 | 90 | 34 | m | 89-91 | 90-93 |

| Bra Band size: | |
|---|---|
| USA | Italy |
| 30 | 1 |
| 32 | 2 |
| 34 | 3 |
| 36 | 4 |
| 38 | 5 |

In order to counteract this effect, the 85B Bra size calculator calculates the result for each national standard separately using the correct method for each.

Entering these measurements in their respective fields of the 85B Bra size calculator:

1. Band size: 30
2. Bust size: 36
3. Above bust: 34

Calculated, the US and UK sizes are shown as 34B but the European size is 75C and not 75B, as may have been expected. The calculator converted the inch measurements to centimeters and then calculated the European size according to standard EN 13402. At the same time it calculated the US sizing using the standard method and the UK size with the method used in the UK.

European clothes sizes follow the European Standard EN13402. The 85B Bra six calculator adheres to this standard.

From the Eve's Apple website: "To calculate your bra size Eve's Apple Breast Conversion Chart (patent pending) was created for small and petite busts from Eve's scientific findings while utilizing another scientifically based method created by Dr. Pechter. Pechter was a plastic surgeon who created a method of getting bra sizes by measuring each individual breast.

This is the closest method to getting an accurate bra size. However, breast shape, tissue fullness and placement can greatly alter the final bra size, regardless of measurements".

| breast conversion chart | | | | | | | | | | | |
|---|---|---|---|---|---|---|---|---|---|---|---|
| | | 4.5 | 5 | 5.5 | 6 | 6.5 | 7 | 7.5 | 8 | 8.5 | 9 |
| band size | 23 | 26A/B | 26B | 26B/C | 26C | 26C/D | 26D | 26D/DD | 26DD | 26DD/E | 26E |
| | 24 | 28A | 26B | 28B | 26C | 28C | 26D | 26D | 26DD | 28DD | 28E |
| | 25 | 28A | 28A/B | 28B | 28B/C | 28C | 28C/D | 28D | 28D/D | D28DD | 28DD/E |
| | 26 | 28A | 30A | 28B | 30B | 28C | 30C | 28D | 30D | 28DD | 30DD |
| | 27 | 30AA/A | 30A | 30A/B | 30B | 30B/C | 30C | 30C/D | 30D | 30D/DD | 30DD |
| | 28 | 32AA | 30A | 32A | 30B | 32B | 30C | 32C | 30D | 32D | 30DD |
| | 29 | 32AA | 32AA/A | 32A | 32A/B | 32B | 32B/C | 32C | 32C/D | 32D | 32D/DD |
| | 30 | 32AA | 34AA | 32A | 34A | 32B | 34B | 32C | 34C | 32D | 34D |
| | 31 | 34AA/AA | 34AA | 34AA/A | 34A | 34A/B | 34B | 34B/C | 34C | 34C/D | 34D |
| | 32 | 36AAA | 34AA | 36AA | 34A | 36A | 34B | 36B | 34C | 36C | 34D |
| | 33 | 36AAA | | 36AA | 36AA/A | 36A | 36A/B | 36B | 36B/C | 36C | 36C/D |
| | 34 | 36AAA | 38AAA | 36AA | 38AA | 36A | 38A | 36B | 38B | 36C | 38C |

The above European chart shows that if you measure at 34", the B cup is 89-91 and the C cup is 90-93.

The website called 85B includes an international bra size calculator. It measures: (1) "below the breast" band size;

(2) "around the breasts and back" (bust size); and (3) "above the breasts" (above bust size).

International variance and equivalent sizes:

It is common for manufacturers of any country to attach size labels to their garments which quote their equivalent sizes in a number of different countries. Unfortunately, these are often inaccurate. An example may help explain the problem. A bra made in Europe which corresponds to the European size 75B, for instance, will most probably be labeled as 34B (USA) and 34B (UK) and, as the method of calculation for cup size differ in these countries, it is possible that the physical size of the cup may differ also. In some cases the band size may also differ.

U.S. Pat. No. 5,965,809A to Pechter discloses a method of bra size determination by direct measurement.

The patent describes the problem of obtaining accurate and correct measurements of the breasts.

In the background of the invention he discloses it is often reported that 70% or more of women wear the wrong size bra. It appears that the current method or procedure of determining women's bra size is unreliable a majority of the time. The traditional method of bra measurement is complicated and often yields an improper size which does not correlate to a woman's correct and proper cup size. Improper size renders the wearing of such a bra uncomfortable and may cause other medical problems. Specifically, conventional bra size is determined by two measurement factors such as the "band size" and "cup size".

The band size is expressed in inches while the cup size is represented by a letter such as A, B, C, etc. Band size is determined by measuring the wearer's chest circumference snugly with an incremented tape immediately below the breasts and around the torso. Then five inches is added to the chest circumference measurement. If the sum is an odd number, the sum is rounded to the next highest even number since bras are offered in "even" numbered sizes. Although band size relates to cup size and may continue to be included in a measurement procedure, only the cup size measurement is considered obsolete. The determination of band size is relatively objective compared to the usual subjective method of determining cup size.

The traditional method of determining cup size does not rely on direct measurement of the breast but instead relates to measurement of the circumference of the chest or torso immediately below the breast, sometimes referred to as chest circumference, diaphragm size or body size, etc., to the circumference of chest around the fullest part of the breasts sometimes referred to as bust measurement, cup size, bust size, breast size or bosom. Cup size is determined by comparing band size with bust measurement, the latter being determined by measuring the circumference of the chest loosely with a measuring tape around the fullest part of the breasts, usually at the level of the nipples, with the woman wearing a bra. A difference of one inch equals an A cup, two inches a B cup, three inches a C cup, and so on.

It appears that the goal of the conventional method of determining bra measurement seems to be to determine cup size by comparing the circumference of the chest at the level of the breasts to the same measurement excluding the breasts. Since the latter measurement cannot be made directly, the addition of five inches to the underbust measurement represents an extrapolation or "fudge factor" to approximate that goal.

To compensate for measurement or extrapolation error, elastic is placed in the band of the bra as well as adjustable attachment means which are used to connect the opposite ends of the bra band together. Separate elastic compensating tabs or extensions are used to extend the length of the bra and in some instances multiple rows of attachment loop and hooks are employed to achieve compensation.

Therefore, a long-standing need has existed to provide a new method or procedure for determining proper bra size by utilizing direct breast measurement techniques, especially the technique of determining cup size by measuring the circumference of an unclothed breast.

The solution of the above problems and difficulties are avoided by the novel method of direct measurement to determine cup size of the breast. The method includes band size measurement by initially measuring the user's chest or torso circumference with a tape measure immediately below the breasts followed by the step of adding five inches to the measured number and incorporating conventional rounding off procedures. Next, cup size is determined by directly measuring with a flexible tape measure the circumference of each unclothed (bare) breast from the beginning of the breast mound at one side laterally to the parasternal area medially. In some instances, measurements are taken while the woman is standing and in other instances, the woman is in a supine position. Next, a measurement conversion is made wherein a measurement of seven inches corresponds to an "A" size cup, eight inches a "B" size cup, nine inches a "C" cup, etc. Each one inch increment determines a cup size Pechter's invention recognizes the "fudge" factor, or guesswork and approximation in measurements for both bra sizing and implant sizing, but does not address the fact that whatever method is used to measure the breasts and the body, the industry sizing and method for determining sizes in bra manufacturing accommodates a limited selection of customers based on averages of breasts, shapes, volumes, and spacing.

Dr. Pechter also developed a system of sizing. In an article in Cosmetic Surgery Times he explained that he tried to come up with a measuring system, paying attention to women's sizes before, during and after breast augmentation by measuring the breasts. He took into consideration that cup size varies with band size. He explained If you are going to do breast surgery, particularly breast augmentation you need to know how to measure a woman's bra size because most women speak in terms of bra size. She might say I want a full C cup but if she has no idea how to measure for a bra, it is that much more difficult to achieve her goal. Dr. Pechter has the patient's band size and uses a sizing implant during surgery to increase her breast width to the cup size that she wants. "If a woman who wears a 36-inch bra and her breast measures 7 inches across (an A cup) wants to be a C cup, during surgery I would increase the width of her breast from 7 inches to 9 inches. Then I would be quite confident that post operatively, she would fit into a 36C bra."

Dr. Pechter's method for Determining Bra Size For Breast Augmentation from Implant Info website is explained and shown below:

"Many women express their goals for breast surgery in terms of bra size; yet the traditional method of bra sizing is confusing and inaccurate, with up to 80 percent of women said to be wearing the wrong size bra. In response to this problem, a new system of bra measurement was developed. It is a modified version of a previously reported method of bra sizing that determines cup size by direct breast measurement while now allowing for the fact that cup size varies with band size (e.g., the C cup of a size 36 bra is larger than the C cup of a size 34 bra).

With this system, brassiere band size is still determined by the industry standard of "underbust chest circumference plus 5," but cup size is determined by the relationship of breast width to underbust circumference. Breast width is measured with a tape from the breast mound's origin on the lateral chest wall to its termination in the parasternal area. Small or firm breasts can be measured with a woman upright or supine, and large or ptotic breasts are measured with the subject supine.

A woman with 500-cc silicone implant with a bust circumference of 36 inches, underbust circumference is 29 inches, breast width is 9.5 inches, bra size by traditional measuring system is 34B,and bra size by new measuring system is 34D. The 34B bra is too small, it has gapping across the lower sternum and it provides inadequate breast coverage. The 34D bra fits well.

Breast width and chest wall measurements were studied in relationship to bra fit in more than 1,000 women undergoing breast surgery over a period of 5 years, until a consistent relationship between the two was established. The correlation of breast width and underbust circumference to bra size is shown in the table below. The relationships are most easily understood by examining the "prime" sizes, which are denoted by the asterisks in the table. For any given underbust circumference, every 1 inch increase or decrease in breast width changes the cup by one size. For example, a woman with a 33-inch underbust and a breast width of 8.5 inches would fit a 38B bra, but if her breast width were 9.5 inches, she would fit a 38C bra.

Conversely, for any given breast width, the cup goes up or down by one size with every alternate step in band size. For example, a woman with a 9-inch breast width and a 3I-inch underbust circumference would wear a 36C bra, but if her underbust circumference were 35 inches, she would wear a 40B bra.

The information in the table below was used clinically to help meet patients' breast surgery goals. For example, if a woman with an underbust circumference of 29 inches (34 band size) wished to be a C cup after augmentation or reduction, an attempt was made to enlarge or reduce her breasts to a width of 8.5 inches.

Breast measurements are helpful in breast augmentation and reduction and in quantifying the difference in size in women with asymmetrical breasts, with each I-inch increment corresponding to a cup size".

Implants come in many sizes none of them correspond to cup size. Implant sizes are named by the volume of the solution (either saline or silicone) that the implant holds often measured in CC's or cubic centimeters. Cup sizes are determined in relation to band sizes so a Doctor can't tell for sure that your new size will be a C.

The first step to buying a bra after the surgery should be to get a professional fitting to determine your new size.

One thing to keep in mind when buying post augmentation bras: Implants are often wider than natural breasts, so you may need to look for a fuller coverage cup than you're used to. Because the implants are semi hemispheric or hemispheric making the breasts the same, the breast root is orbital not like a natural breast".

Chart For Determining Your Breast/Bra Size

| Breast | Under-Bust Circumference | | | | | | | | |
|---|---|---|---|---|---|---|---|---|---|
| Width | 27" | 28" | 29" | 30" | 31" | 32" | 33" | 34" | 35" |
| 5" | 32AA* | 32AA | | | | | | | |
| 5.5" | 32AA/A | 34AA | 34AA* | 34AA | | | | | |
| 6" | 32A* | 32A | 34AA/A | 36AA | 36AA* | 36AA | | | |
| 6.5" | 32A/B | 34A | 34A* | 34A | 36AA/A | 38AA | 38AA* | 38AA | |
| 7" | 32B* | 32B | 34A/B | 36A | 36A* | 36A | 38AA/A | 40AA | 40AA* |
| 7.5" | 32B/C | 34B | 34B* | 34B | 36A/B | 38A | 38A* | 38A | 40AA/A |
| 8" | 32C* | 32C | 34B/C | 36B | 36B* | 36B | 38A/B | 40A | 40A* |
| 8.5" | 32C/D | 34C | 34C* | 34C | 36B/C | 38B | 38B* | 38B | 40A/B |
| 9 | 32D* | 32D | 34C/D | 36C | 36C* | 36C | 38B/C | 40B | 40B* |
| 9.5" | 32D/DD | 34D | 34D* | 34D | 36C/D | 38C | 38C* | 38C | 40B/C |
| 10" | 32DD* | 32DD | 34D/DD | 36D | 36D* | 36D | 38C/D | 40C | 40C* |
| 10.5" | | 34DD | 34DD* | 34DD | 36D/DD | 38D | 38D* | 38D | 40C/D |
| 11" | | | | 36DD | 36DD* | 36DD | 38D/DD | 40D | 40D* |
| 11.5" | | | | | | 38DD | 38DD* | 38DD | 40D/DD |
| 12 | | | | | | | | 40DD | 40DD* |

*The asterick denotes "prime" brassiere sizes*

In the same article in Cosmetic Surgery Times, Dr. Brothers a plastic surgeon said "Following breast augmentation, the breast size and shape change in a way that conventional bras do not address".

Augmented breast sizes and shapes are different from natural breasts. A natural bust is usually weighted at the bottom below the nipple, and the breast tissue is pliable and more widely dispersed on the chest wall. The base diameter of an implant is relatively narrower than a natural breast and the shape is more hemispheric. Augmented breasts do not fit into ordinary bras nor do they have the same dimensions. Augmented breasts are relatively immovable.

In an article in Allure magazine "How to Spot Fakes" the obvious signs of augmented breasts are described:

"Fake breasts have a defined 360 degree border around the edges. Implants create a wide, often bony gap between the breasts. From the side fake breasts can look as full on top as on the bottom The nipple points down. Naturally, nipples point straight ahead or slightly up, even with a moderate amount of sagging. If the implants are too high, the nipples tip downward".

The Bra book states "millions of women are opting to go under the knife for bigger- or smaller boobs. In fact for the first time since the American Society of Plastic Surgeons began compiling statistics, breast augmentation was found to be to be the most popular cosmetic surgical procedure, with hundreds of thousands of women undergoing the procedure each and every year. It is a misconception that your doctor can tell your new bra size based on the size of implants inserted.

On the website "Linda's online, Bras after breast Augmentation" states, "Although you may have discussed your ideal cup size with your doctor, breast implants are not sized in cup sizes. You will still have to measure yourself to determine your new size. Because augmented breasts tend to be rounder than natural breasts, you may "look like "a smaller cup size than you actually need to wear.

Not all bras work well for augmented breasts. You'll want to avoid bras that are high on the sides of the breast, because women with implants tend to have less breast tissue at the sides.

It is stated on the website "Her Room, Measuring for Proper Fit with Implants", "Implants tend to run wider than a natural breast, and your existing breast tissue prior to surgery needs to also be accounted for. Therefore, even if you feel like you are a C cup, you may need to go up to a D cup to get the right size underwire to fit. Also, doctors will claim you as a "full" cup, which means that you now have an additional ½ cup size increase. This can also push you to another cup size. Breast implants are measured in cubic centimeters (ccs). 175 to 200 ccs is the equivalent to one cup size increase. Knowing the size of your implants will also help you determine your new cup size.

Breast implant surgery should not change your band size. Calculating your band size with implants is performed exactly the same way as normal sizing. For cup sizing, it is recommended, with your tape measure parallel to the floor, measure your breast from where your breast begins in your cleavage, across your breast apex, then over to where your breast ends near the armpit. With this measurement and your band measurement, use the table below to determine your cup size".

| Breast Measurement (See measurement instructions above) | 32" band (27-28" ribcage): | 34" band (29-30" ribcage): | 36" band (31-32" ribcage): | 38" band (33-34" ribcage): |
|---|---|---|---|---|
| 6" | A | | | |
| 6.5" | FULL A | | | |
| 7" | B | A | | |
| 7.5" | FULL B | FULL A | | |
| 8" | C | B | A | |
| 8.5" | FULL C | FULL B | FULL A | |
| 9" | D | C | B | A |
| 9.5" | FULL D | FULL C | FULL B | FULL A |
| 10" | DD | D | C | B |
| 10.5" | FULL DD | FULL D | FULL C | FULL B |
| 11" | DDD | DD | D | C |
| 11.5" | FULL DDD | FULL DD | FULL D | FULL C |
| 12" | | DDD | DD | D |
| 12.5" | | FULL DDD | FULL DD | FULL D |
| 13" | | | DDD | DD |
| 13.5" | | | FULL DDD | FULL DD |

From the website Connall Plastic Surgery:

"Your Breast Size: In Breast Width:

The next key steps in breast implant sizing are a bit more scientific. You need to know the dimensions of your breasts and chest. Think of these measurements as your real breast size. After all, when you try-on a new dress or pair of shoes you don't select any size at random and see how it looks. Rather, you select your new dress to fit your body and shape, greatly dependent on your predetermined size. Your key dimension for determining your breast size is the width of your breast. The breast width is measured (in centimeters) from the cleavage area to the outer part of your breast, next to your arm. This is measured in a straight line and is not curved around the arc of your breast. Most women's breasts are about 11-14 cm wide.

Breast width is a key dimension for properly fitting breast implants to your body. The width is measured from the inner edge of the cleavage to the outer-most part of the breast. The tape measure is pulled tight and the distance is measured in a flat plane. The tape is not draped or wrapped around the breast to determine this dimension.

Fitting Breast Implant Diameter to Breast Width

Once you know the width of your breasts you can now consider the dimensions of breast implants that would be best for you-An implant slightly narrower or about the same width as the width of your breast is usually a good choice and should fit you well. So, if your breasts are 12 cm wide, you should choose a breast implant with a diameter of about 12 cm. If your implant choice is within ½ to one centimeter of your breast width, you should do well. But, it is best to select an implant that is slightly narrower, rather than wider than your breast. So, in the case of a 12 cm wide breast, an implant with a diameter from 11-12 cm should be satisfactory.

Breast Tissue Thickness is Important

Another important consideration is the thickness of the tissues of your breasts. A woman with thick breast tissues may be able to accommodate a wider implant than a woman with thin breast tissues. This difference relates to how the implant interacts with and stretches the breast tissues and skin, especially over time. In thin patients, wide implants are more likely to stretch and thin the tissues, leading to less padding over the implant and causing visible implant ripples.

Let's go back to our example of a breast that is 12 cm wide. If the breast tissues are very thin, then a narrower implant should be selected. So, an implant with a diameter about 10.5-11.5 cm would be best. During your consultation, Dr. Connall will perform a thorough breast examination which will include measuring your breast dimensions and soft tissue thickness. This information will then be used to help determine which implant would fit you the best.

Selecting a Breast Implant

With all of the key elements considered and evaluated you can then select a breast implant. To do this accurately, all three key dimensions of the implant must be considered. One is implant volume, which we have an idea of based on your desired cup size, your implant "try-on" size, and any photos of augmentations you like. The second is implant diameter, which should be slightly less than the measured width of your breast. The third implant dimension is outward projection, which generally follows according to the diameter of implant you need. But, if you desire a particular breast shape, the projection may be a more important objective to meet than diameter".

U.S. Pat. No. 6,746,306 to Brothers describes a post-operative bilateral augmentation brassiere. A postoperative bilateral augmentation mammoplasty brassiere for use by women with augmented breasts is disclosed. The brassiere provides a support cup shaped to mimic a spherically shaped breast implant. The brassiere further provides an underwire within the construction of the brassiere, the underwire having a semicircular portion to mimic the round base of an augmented breast. A connector is provided between two support cups, each with an associated underwire, such that the distance between proximal ends of the underwires is established for the comfort of the wearer and the attractive appearance of the brassiere.

In the patent, the problems women with augmented breasts have with traditional brassieres is described: "The natural shape of a woman's breasts prior to a bilateral augmentation mammoplasty has a "teardrop" profile with a gentle concave downslope extending from below the clavicle to the nipple. The shape of the inframammary (under the breast) fold of the natural breast has the shape of a flattened semicircle. This flattened semicircular fold is representative of the shape of the similarly shaped underwires used in constructing the known types of brassieres. The shapes of the cups of conventional brassieres are typically conical. A conically shaped brassiere cup does not comfortably accommodate the hemispherical shape of the augmented breast formed by the underlying breast implant. Conically shaped cups typically are tight around the base of the augmented breast, and the rounded bust point of the augmented breast does not fill out the "tip" of the cone leaving excess unattractive fabric in this area, nor is the bust point supported. Although conventional brassiere construction works well for the majority of women who have not augmented their breasts, the known types of brassieres do not provide for the augmented breast shape and related chest wall relationships or the additional support required by a woman with augmented breasts.

The typical augmented breast has a somewhat hemispherical shape, and a convex downslope extending from below the clavicle to the nipple. Additionally, the augmented breast has a relatively smaller base diameter on the chest wall when compared to a natural breast of equal volume. This is the reason many women with augmented breasts have a wide cleavage or medial distance between the breasts. Additionally, the inframammary folds have been lowered. The bust point, or nipple, also has a greater anterior projection than that of a natural breast, and the inframammary fold is now a true semicircle in accordance with the circular shape of the round breast implant.

Current brassieres provide poor support and fit for the woman who has undergone a breast augmentation. For example, after a breast augmentation, a women that is properly measured and should be wearing a 32D brassiere typically cannot find a properly fitting brassiere because this breast size is not a common natural breast size. Such a women is forced to wear a size 34C brassiere due to the adequately sized, although not optimally shaped, underwire provided thereby. However, the brassiere band is too large and breast support is transferred to the shoulder straps resulting in discomfort to the wearer over time. Further, the cups of available brassieres, which are not shaped for augmented breasts, fail to provide appropriate fit to augmented breasts which leads to discomfort and inadequate support.

In conventionally constructed brassieres, the center front connector between the cups also is not wide enough for proper fit on a woman with augmented breasts. The connector typically bowstrings between the augmented breasts and is raised off of the chest wall thus diminishing the brassiere's cantilevered support system. The brassiere cups and breasts are thus forced medially toward center front. Consequently, the cups and underwires are distorted, the cleavage is deepened and the brassiere appears unattractive and too tight. There should be no space between the center front section and the chest wall in a properly fitted, comfortable and attractive brassiere that offers the full benefit of a cantilevered support system. What is needed is a center front connector that eliminates the above-mentioned problems and ensures proper fit, comfort and support for the breasts.

The currently available brassieres do not, therefore, address the specific structural and anatomic needs unique to the growing population of women with breast implants. There is no brassiere that is specifically designed for the shape, size, and relative placement of augmented breasts. The need has thus arisen for a uniquely designed, supportive, and attractive post-surgical brassiere for women who have undergone breast augmentation".

The Brothers invention fits the hemispheric shape and compliments the shape of the implants. The Brothers patent solves these problems for the woman with augmented breasts by changing the shape of the underwire, formed as a slightly lengthened true semicircle with slight center front outward deflection and lateral outward deflection, changing the shape of the cup in that it has an arcuate shape in both the vertical and horizontal directions for creating a "spherical" cup, and changing the defined width of the center front connector, and its relationship to the center front tips of the underwires of the brassiere allowing for better fit, comfort, appearance and support.

SUMMARY OF THE INVENTION

The present invention is directed to an undergarment, which addresses the problems existing in the prior art, discussed above.

In order to solve the disadvantages and shortcomings in the prior art, an object of the invention is to engineer the bra to give a more comfortable fit at the breast root and to maximize the look of the existing bust by extending the breast root and extending the boundary. The invention expands and enhances the breast root while compensating for actual lesser tissue volume inside. We use a wider than standard diameter on the outside (i.e. 34 C diameter on a 34 B cup) and fill in the cup on the inside with fill (i.e. foam, gel, silicone, stitching, knit, mesh, fabric, padding, etc.) to support the breast root and hold up the larger outer cup and diameter. In other words, we keep everything the same on the outside as a 34C for a 34B volume, except the projection. By using a wider diameter than the breast root, we are able to engineer the bra in a different manner We are also able to design from a wider base per inside volume and enhance the breasts in the width first, as opposed to a forward projection first. The cups have an inside criteria and an outside criteria. The inside is designed to support the larger diameter and to accommodate lesser volume. By enhancing the breast at the root we are able to project in the widthwise and forward projection, or just the widthwise projection. By using a larger diameter this also enables the cup to have a wider apical spread inside leaving more room for breast variation and spacing variation. The outside is designed to have a simulated look of a beautiful bust. We created the outside of the cup to look like a well-proportioned breast based on the outer diameter, and we created the inside to compensate for the differences in volume, shape, and size.

It is an object of this invention to provide a brassiere which expands the root of the breast as a means of support It is an object of this invention to provide a brassiere which expands the root of the breast as a means of enhancement It is an object of this invention to provide a different means of engineering for a more comfortable fit by using wider cup diameters per volume size.

It is an object of this invention to maximize the look of the existing bust by extending the breast root and extending the boundary, surrounding the breasts with fill, and using larger, wider cups to create a comfortable and well-fitting bra.

It is an object of this invention to provide a brassiere which supports the tissues of the breast on the sides and bottom to give the breast uplift Another object of this invention is to comfortably provide support to the breast using fill between the larger outside diameter wire and the breast tissue.

Another object of this invention is to provide a bra with special tension engineering which balances the elevation and weight of the breasts in their normal position yet not apply undue pressure on any part of the breast because of pulling of the band or shoulder strap Another object of this invention to provide a brassiere which has a beautifully proportioned outer shape irrespective of the tissue volume inside the cup Another object of this invention is to emphasize voluptuousness with width fullness.

Another object of this invention is to camouflage areas of the breasts that are missing volume and fill in areas of shallow breast tissue Another object of this invention is to fill in areas medially between wide spread bust points and extend the width of the bust medially Another object of this invention is to fill in areas laterally and extend the width of the bust laterally Another object of the invention is to enhance fit and comfort of augmented breasts and disguise telltale signs of implants Another object of this invention is to provide a "fudge factor" inside the cups to accommodate a wider range of breast sizes and shapes within a given size Another object of this invention is to provide alternative cup sizes and projections to expand size offerings and choices in the marketplace to accommodate a broader range of customers The interior accommodates the shape of the breast on three sides. The exterior's larger diameter surrounds the interior from a wider base diameter which allows a different type of cup design. The wider diameter and inner foam (fill) allows room for tissue disbursement from a wider base. The larger diameter with supportive foam (etc.) surrounding the wider perimeter makes the cup more adaptable.

When industry talks about cup size it is a means to describe breast projection (anteriorly). Industry measures the breast tissue volume by taking an around the bust measurement and a torso measurement and determining the difference between the two. That number, i.e. 1", 2", 3", 4" etc. (A, B, C, D, etc.) determines a close fitting standard diameter. The breasts are then enhanced with cup placement, push-ups, padding projection and cleavage.

The present invention cannot be graded from a standard. A 34C diameter is used on the outside of the 34B/c cup and, in order to do that, a fill is created inside to replace the breast tissue that is missing to hold up the larger diameter of the cup. In this patent, when referring to industry cup size, industry diameter per volume is i.e. 34A cup=4⅙" diameter and industry projection per measurement is i.e. A cup=1" front projection. This invention enhances tissue around the breast root using a larger diameter than standard volume, i.e. we use about a 4½" diameter which industry uses for a B cup for our A/b cup, while compensating with fill for lesser tissue volume inside. The line is sized and the bra is engineered using a wider base cup diameter per volume than standard which is something that has not been done or considered in prior art.

This invention places the external bust points in a position that is proportioned for the outside diameter cup, irrespective of the placement of the inner apex and the outside cup is designed to the larger diameter.

We developed our own sizing system different from industry. We use the same industry criteria to determine the band and cup size to try to keep a consistency for the customer who is accustomed to buying bras with band sizes and letters. We identified our sizes in the form of combinations of the band, inner cup size, and outer cup size. For the inner cup volume, the outer diameter is larger than standard (ie 34B inside volume has a 34C outside diameter and is called 34B/c and a 34B inside volume and a 34D outside diameter is called 34B/d).

A new sizing system has been established to identify the sizes.

In this invention the brassiere takes into account breast volume.

An aspect of the invention provides a brassiere including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour having a non standard A diameter and volume and an outer contour having a size larger than a standard A cup between a standard size A and a standard size B, and filling material provided between the inner contour and the outer contour; and a gore connected to each of the first cup and the second cup, between the first cup and the second cup.

A further aspect of the invention provides a brassiere, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour having a size between a standard A cup and a standard B cup, and an outer contour having a size between a standard B cup and a standard C cup, and filling material provided between the inner contour and the outer contour; and a gore connected to each of the first cup and the second cup, between the first cup and the second cup.

A further aspect of the invention provides a brassiere, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour having an inner contour diameter, and an outer contour having an outer contour diameter larger than the inner contour diameter, and filling material provided between the inner contour and the outer contour in a medial lower and lateral cup portion; and a gore connected to each of the first cup and the second cup, between the first cup and the second cup.

An aspect of the invention provides a brassiere, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour shaped with an inner apex, and an outer contour having a size larger than the inner contour and shaped with an outer apex spaced either medially, centered or laterally from the respective inner apex, and filling material provided between the inner contour and the outer contour; and a gore connected to each of the first cup and the second cup, between the first cup and the second cup.

A further aspect of the present invention provides a brassiere, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour having an inner contour diameter, and defining a first volume and a first size, and an outer contour having an outer contour diameter a size larger than the inner contour diameter and defining a second volume and second size larger than the first volume and first size, and filling material provided between the inner contour and the outer contour; and a gore connected to each of the first cup and the second cup, between the first cup and the second cup.

An aspect of the invention provides a brassiere, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour having an inner contour diameter, and an outer contour having an outer contour diameter size larger than the inner contour diameter, and filling material provided between the inner contour and the outer contour in a medial, lower and lateral portion of each of the cups to provide a natural fit and to fill in medial breast portion, lower breast portion, and lateral breast portion; and a gore connected to each of the first cup and the second cup, between the first cup and the second cup.

A further aspect of the invention provides a brassiere including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour, and an outer contour having a diameter size larger than the inner contour, and filling material provided between the inner contour and the outer contour in a medial, lower and lateral portion of each of the cups wherein the outer contour diameter of each cup is larger than standard cup diameters per inside volume to allow the extended breast root fill on the inside to counterforce the cup, the breast, the underwire and the rib cage.

An aspect of the present invention provides a line of brassieres, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour, and an outer contour having approximately a size larger than the inner volume, and approximately a diameter size larger than the size of the inner volume and filling material provided between the inner contour and the outer contour; and a gore connected to each of the first cup and the second cup, between the first cup and the second cup.

A further aspect of the present invention provides a line of brassieres, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour, and an outer contour having approximately two sizes larger, and approximately two diameter sizes larger than the size of the inner volume, and filling material provided between the inner contour and the outer contour; and a gore connected to each of the first cup and the second cup, between the first cup and the second cup.

A further aspect of the invention provides a line of brassieres, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour, and an outer contour having a size larger than the inner volume, and a diameter larger than the size of the inner volume and filling material provided between the inner contour and the outer contour; and a gore connected to each of the first cup and the second cup, between the first cup and the second cup; wherein the line is sized with a nonstandard sizing with a nonstandard inside cup volume and diameter and a nonstandard outside cup diameter in which the filling material is positioned higher than in the standard sizing and in which the filling material is positioned wider than in the standard sizing. An aspect of the invention further provides the brassiere, wherein each cup extends further medially and laterally than standard cups per inside volume to enhance breast root and breast tissue. A further aspect of the invention provides the line of brassieres, wherein the cups are spaced further apart than standard cups to enable the gore to contact a chest wall for proper fit, and to enable edges of the cups to extend laterally and medially to the outer edges of the breasts. Further, an aspect of the invention provides the brassiere, wherein the cups are configured to be positioned on the breasts to fill in tissue deficits medial, lower and lateral. The brassiere may include each cup diameter is larger than standard cup diameters per inside volume size to extend the area of breast root and to augment the breast. In the brassiere, lateral projection of the cups may be increased over standard lateral cup projection to enhance the lateral curve of the breast. Medial projection of the cups may be increased over standard medial cup projection to enhance the medial curve of the breast. Each cup may include a pad on an upper portion of the inner contour that extends higher on the medial and lateral sides than standard. The brassiere may be incorporated into swimwear. The brassiere may be incorporated into exercise wear. The nonstandard sizing may be based on, inner cup size, outer cup size and band size.

The nonstandard sizing may be based on inner cup size, outer cup size, band size and inner bust point spacing, for one of (a) less than 6½" between inner bust points, and (b) greater than 6½" between inner bust points. The nonstandard sizing may include for a band width of one of 26", 28", 30", 32", 34", 36", 38", and 40", cups (AA/a), (A/b), (B/c), (C/d), (D/e), and (E/ee), and inside volume (AA)<1", (A) 1", (B) 2", (C) 3", (D) 4", (E) 5", Size 34A/b=34 band measured according to industry, 34AA/a=34 band, A inside volume (approx <1" projection), (less than 310 cc), A outside diameter (approx 4⅙"), 34A/b=34 band, A inside volume (approx 1" projection), (about 310-380 cc), B outside diameter (approx 4½"), 34B/c=34 band, B inside volume (approx 2" projection), (about 390-470 cc), C outside diameter (approx 4⅚"), 34C/d=34 band, C inside volume (approx 3" projection), (about 480-580 cc), D outside diameter (approx 5⅙"), 34D/e=34 band, D inside volume (approx 4" projection), (about590-700 cc), E outside diameter (approx 5½"), 34E/ee=34 band, E inside volume (approx 5" projection), (about 710-850 cc), ee outside diameter (approx 5⅚").

An aspect of the invention provides a brassiere, including a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour shaped with an inner apex, the inner contour having a first volume and a first size and an outer contour having a size larger and a diameter size larger than the inner contour and shaped with an outer apex spaced either medially, centered or laterally from the respective inner apex, and filling material provided between the inner contour and the outer contour in a medial lower, and a lateral portion in each of the cups to provide a natural fit and to fill in medial, breast portion, lower breast portion and lateral breast portion; and a gore connected to each of the first cup and the second cup, between the first cup and the second cup.

An aspect of the invention provides a brassiere, comprising a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour shaped to substantially match a breast to receive the breast, and an outer contour having a diameter size larger than the inner volume and filling material provided between the inner contour and the outer contour in medial, lateral and lower points of each of the cups to fill in the space between the breast root and the larger diameter of the cup, whereby minimal pressure is exerted on the breast or breast root; and a gore connected to each of the first cup and the second cup, between the first cup and the second cup.

A further aspect of the invention provides a brassiere cup, including an inner contour shaped with an inner apex, the inner contour having a first volume and a first size and an outer contour having a size larger and a diameter size larger than the inner volume and shaped with an outer apex spaced either medially, centered or laterally from the respective inner apex, and filling material provided between the inner contour and the outer contour in a medial lower, and lateral portion in each of the cups to provide a natural fit and to fill in medial, breast portion, lower breast portion and lateral breast portion.

An aspect of the invention provides a brassiere cup insert, including an inner contour shaped to substantially match a breast to receive the breast, and an outer contour having a breast root diameter size larger than the inner volume, and filling material provided between the inner contour and the outer contour in medial, lateral and lower portions of each of the cups to surround medial, lateral and lower breast portions. A brassiere cup insert includes an inner contour shaped with an inner apex, the inner contour having a first volume and a first size and an outer contour having a size larger and a diameter size larger than the inner volume and shaped with an outer apex spaced either medially, centered or laterally from the respective inner apex, and filling material provided between the inner contour and the outer contour in a medial lower, and lateral portion in each of the cups to provide a natural fit and to fill in medial, breast portion, lower breast portion and lateral breast portion.

A brassiere cup insert includes an inner contour shaped with fill to substantially match a breast to receive the breast in a cup having a diameter size larger than the inner volume to fill in areas in medial, lateral and lower portions of the cups to surround medial, lateral and lower breast portions. A brassiere may include a first wing and a second wing, each wing including a first end and a second end; a closure including a first closure portion provided on the first end of the first wing and a second closure portion provided on the first end of the second wing; a pair of cups, a first cup connected to the second end of the first wing, and a second cup connected to the second end of the second wing; each cup including an inner contour shaped with an inner apical zone and an outer contour having a size larger than the inner contour and shaped with an outer apex spaced one of medially, on center or laterally from the inner apical zone, and filling material provided between the inner contour and the outer contour; and a gore connected to each of the first cup and the second cup, between the first cup and the second cup.

An aspect of the invention provides a method of designing a line of brassieres, each having a pair of wings, a pair of cups connected to the pair of wings, and a gore connected between the cups, the method including determining an outer contour of each cup shaped with an outer apex, determining an inner contour of each cup in such a manner that each inner contour has a volume size smaller than the outer diameter and contour and is shaped with an inner apex spaced one of medially, centered or laterally from the respective outer apex, and determining a configuration of filling material provided between the inner contour and the outer contour so as to fill in space between the breast root and the larger diameter cup whereby minimal pressure is extended on the breast or breast root.

A further aspect of the invention provides a method of designing a line of brassieres, each brassiere having a pair of wings, a pair of cups connected to the pair of wings, and a gore connected between the cups, the method including determining an outer diameter and contour of each cup shaped with an outer apex, determining an inner contour of each cup in such a manner that each inner contour has a volume size smaller than the outer diameter and contour, and determining a configuration of filling material provided between the inner contour and the outer contour in medial, lateral, and lower portions of each of the cups to provide a comfortable fit and to surround medial, lateral, and lower portions. A method of designing a line of brassieres, each brassiere having a pair of wings, a pair of cups connected to the pair of wings, and a gore connected between the cups, may include determining an outer contour of each cup shaped with an outer apex, determining an inner contour of each cup in such a manner that each inner contour has a volume smaller than the outer diameter and contour and is shaped with an inner apex spaced one of medially, centered or laterally from the respective outer apex, and determining a configuration of filling material provided between the inner contour and the outer contour so as to fill in space in medial, lateral, and lower portions of each of the cups to provide a comfortable fit and to surround medial, lateral, and lower portions of augmented breasts between the breast root and the larger diameter whereby minimal pressure is extended on the breast or breast root.

A method of designing a line of brassieres, each brassiere having a pair of wings, a pair of cups connected to the pair of wings, and a gore connected between the cups, may include determining an outer contour of each cup shaped with an outer apex; and determining an inner contour of each cup in such a manner that each inner contour has a volume smaller than the outer diameter and contour and determining an outer contour to create the illusion of a natural breast for augmented breasts.

A line of brassieres for augmented breasts, each brassiere having a pair of wings, a pair of cups connected to the pair of wings, and a gore connected between the cups, the line includes an outer contour of each cup shaped with an outer apex; an inner contour of each cup that each inner contour has a volume smaller than the outer diameter and contour and is shaped to support the augmented breast; and determining an outer contour to create the illusion of a natural breast.

A method of designing a line of brassieres, each brassiere having a pair of wings, a pair of cups connected to the pair of wings, and a gore connected between the cups, the method may include determining a desired shape of a cup using a wider diameter than standard inside volume, using a larger diameter than the inframammary fold diameter standard. A method of bra engineering may use a larger diameter per volume size than standard and using the inside fill to cushion the space between the inframammary fold, the breast and the diameter wire. A method of bra engineering may use larger cup diameters per volume than standard volume size, using larger outer cups, using fill wider and higher than standard size cups per volume to counterforce the bra. A method of breast root support may use an extended breast root measurement, larger than the inframammary fold and fill between the breast root and the larger diameter. A method of breast enhancement may use larger diameters than standard diameters per volume, and fill around the breast root medially, underneath and laterally.

BRIEF DESCRIPTION OF THE DRAWINGS

The above and other objects, features and advantages of the present invention will be made apparent from the following description of the preferred embodiments, given as no limiting examples, with reference to the accompanying drawings in which:

FIG. 21 is a depiction of FIGS. 3 and 4 of U.S. Pat. No. 5,485,855.

DETAILED DESCRIPTION OF THE INVENTION

The present invention is directed to an undergarment, and more particularly to a brassiere.

Figure 5:
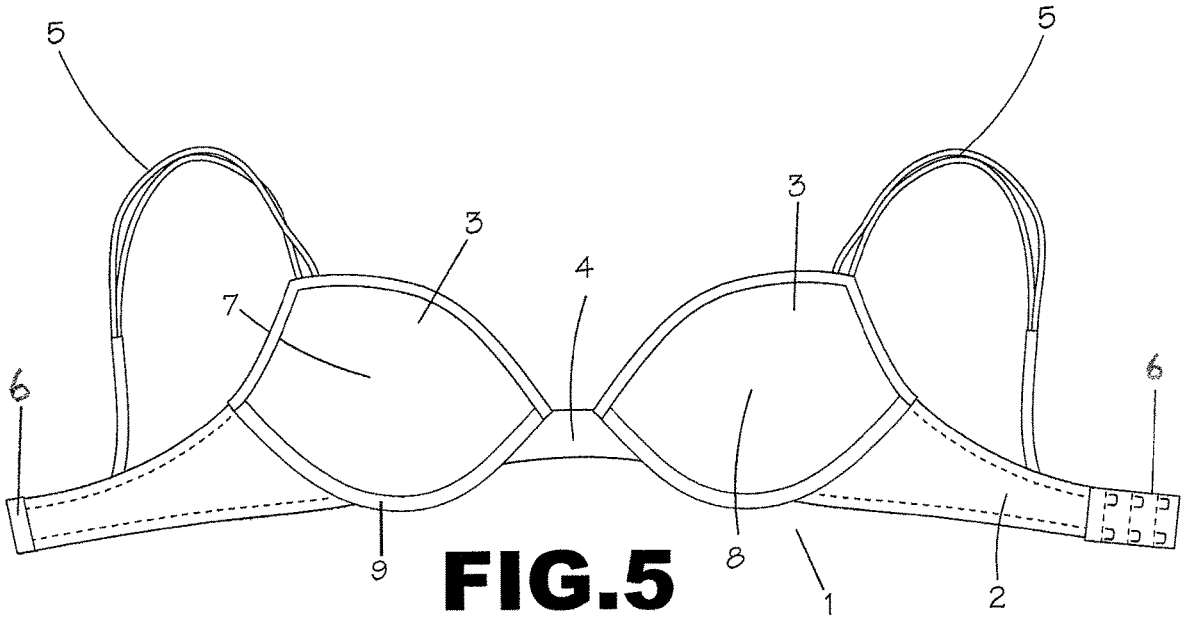
FIG. 5 is a front view of a brassiere according to an embodiment of the present invention.
Figure 6:
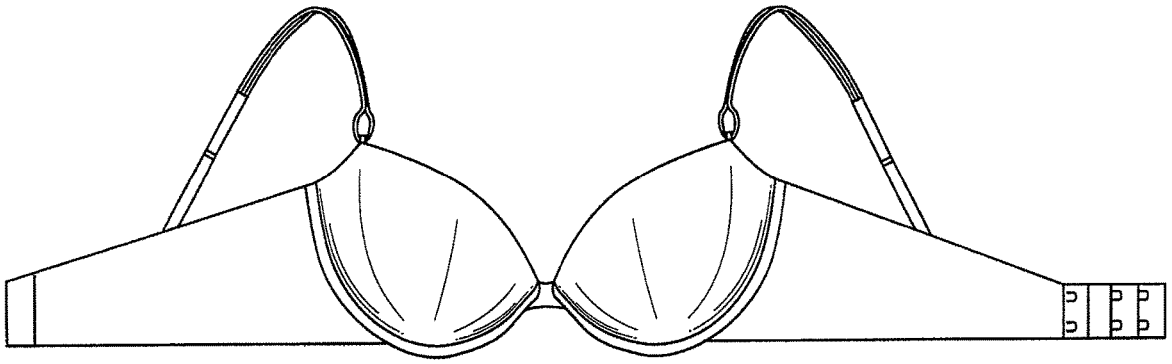
FIG.6 PRIOR ART
FIG. 6 is a front view of a prior art brassiere.
Figure 7:
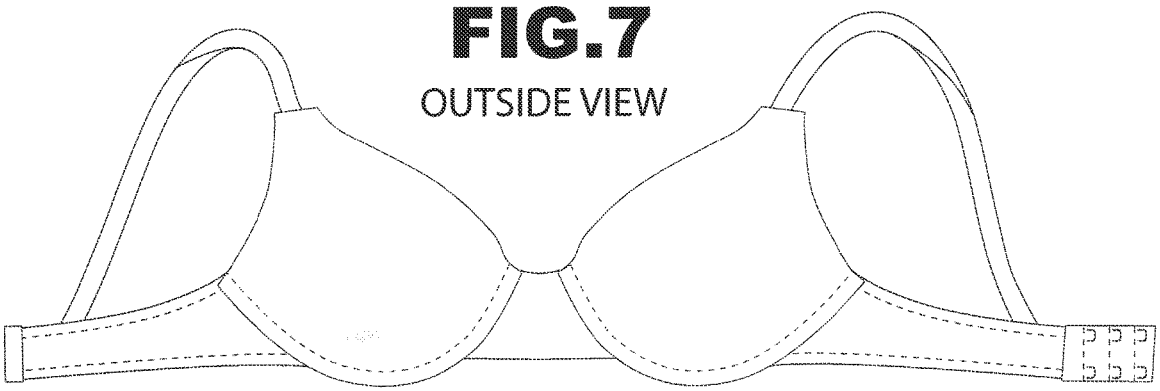
FIG. 7 is a front view of a brassiere according to an embodiment of the present invention.
Figure 8:
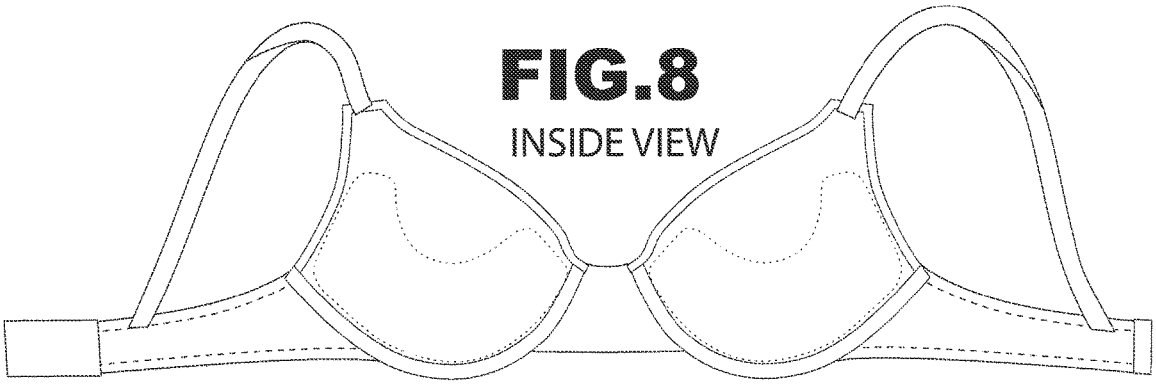
FIG. 8 is a rear view of a brassiere according to an embodiment of the present invention.
Figure 9:
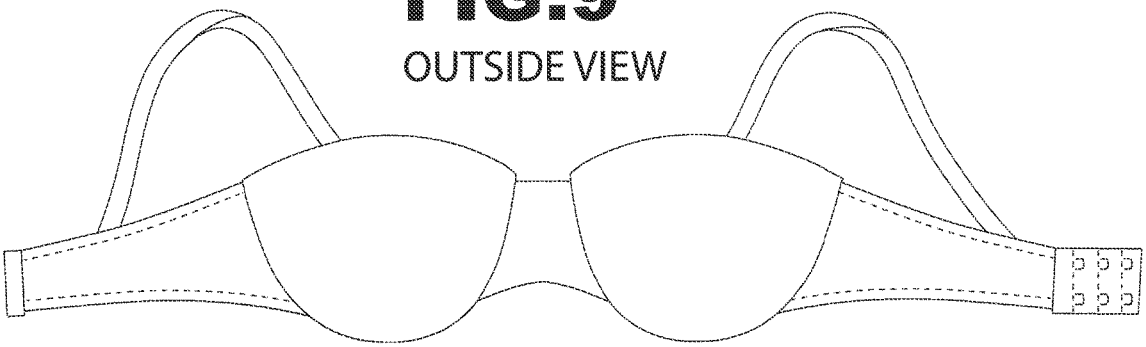
FIG. 9 is a front view of a brassiere according to another embodiment of the present invention, showing an outside view of the brassiere.
Figure 10:
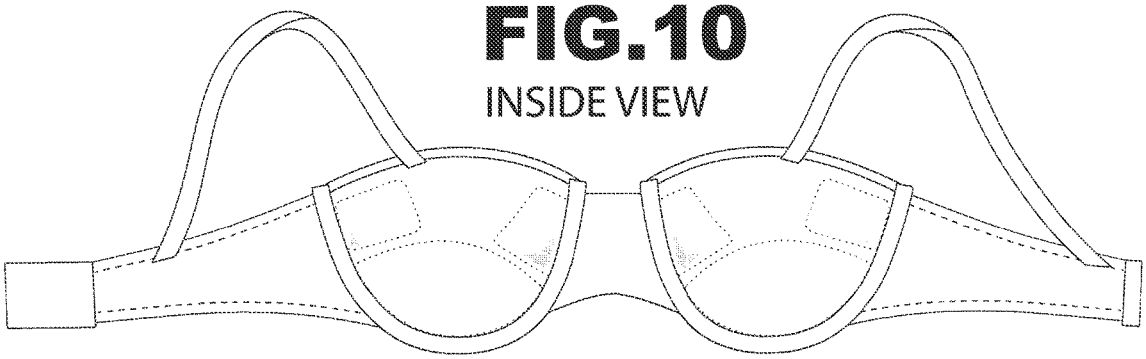
FIG. 10 is rear view of a brassiere according to an embodiment, showing an inside view of the brassiere.

As shown in FIG. 5, the brassiere 1 includes first and second wings, each wing including a first end and a second end, a closure 3 including a first closure portion on the first end of the first wing, and a second closure portion on the first end of the second wing, a pair of cups 3, a first cup connected to the second end of the first wing, and a second cup connected to the second end of the second wing, a gore 4 connected to each of the first cup and the second cup, between the first cup and the second cup; and a pair of straps 5 including a first strap connected to the first cup and the first wing, and a second strap connected to the second cup and the second wing.

As shown in FIG. 5, each cup 3 includes an inner contour shaped with an inner apex 7 substantially matching a breast to receive the breast in a natural bust point position, and an outer contour having a size larger, and a diameter size 9 larger than the inner contour and shaped with an outer apex 8 spaced medially, centered or laterally from the respective inner apex 7, and filling material provided between the inner contour and the outer contour.

Figure 1:
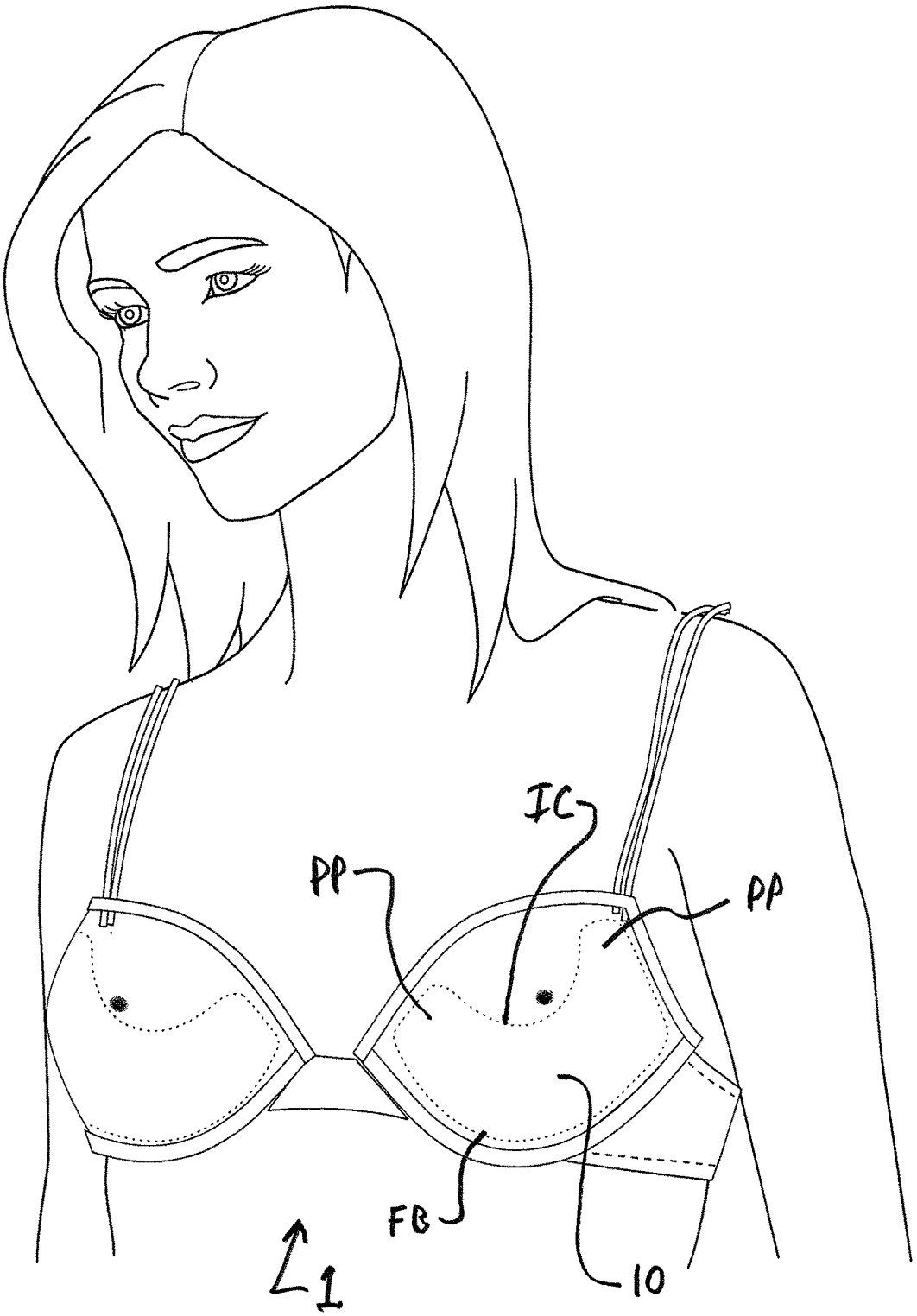
FIG. 1 is a front perspective view of a brassiere according to an embodiment of the present invention, showing an inside view of the brassiere.
Figure 2:
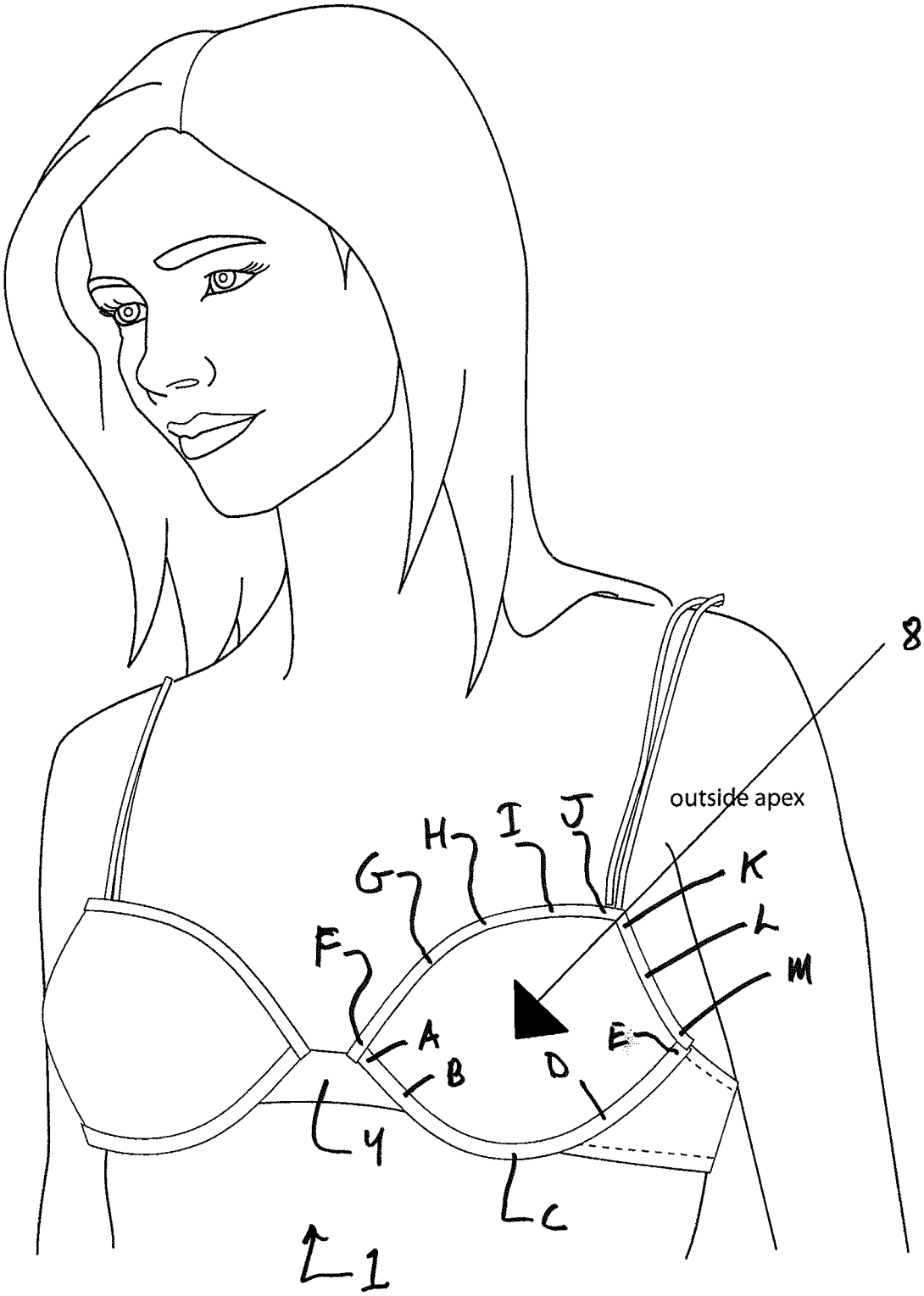
FIG. 2 is a front perspective view of a brassiere according to an embodiment of the present invention, showing an outside view of the brassiere.
Figure 3:
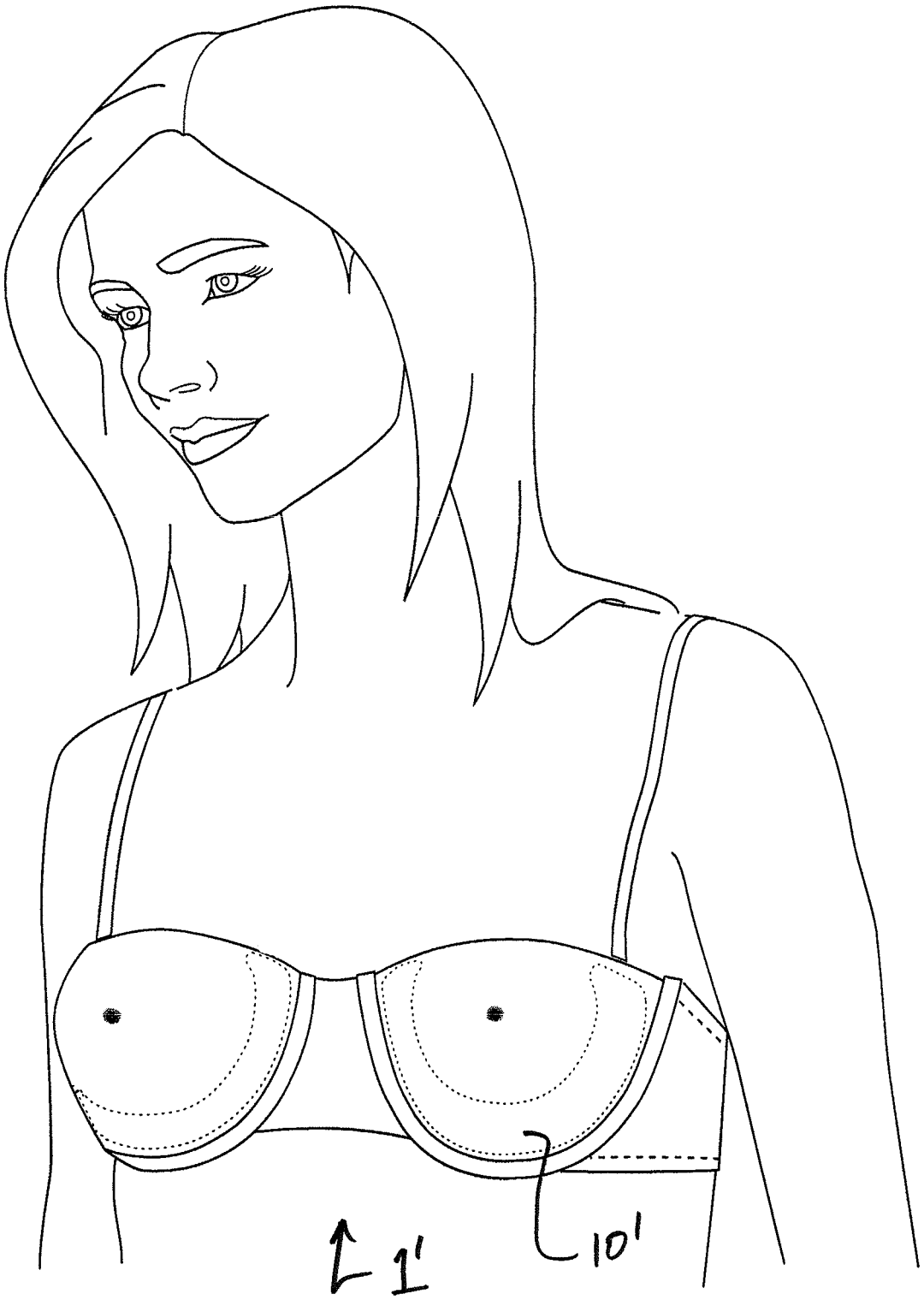
FIG. 3 is a front perspective view of a brassiere according to an embodiment of the present invention, showing an inside view of the brassiere.
Figure 4:
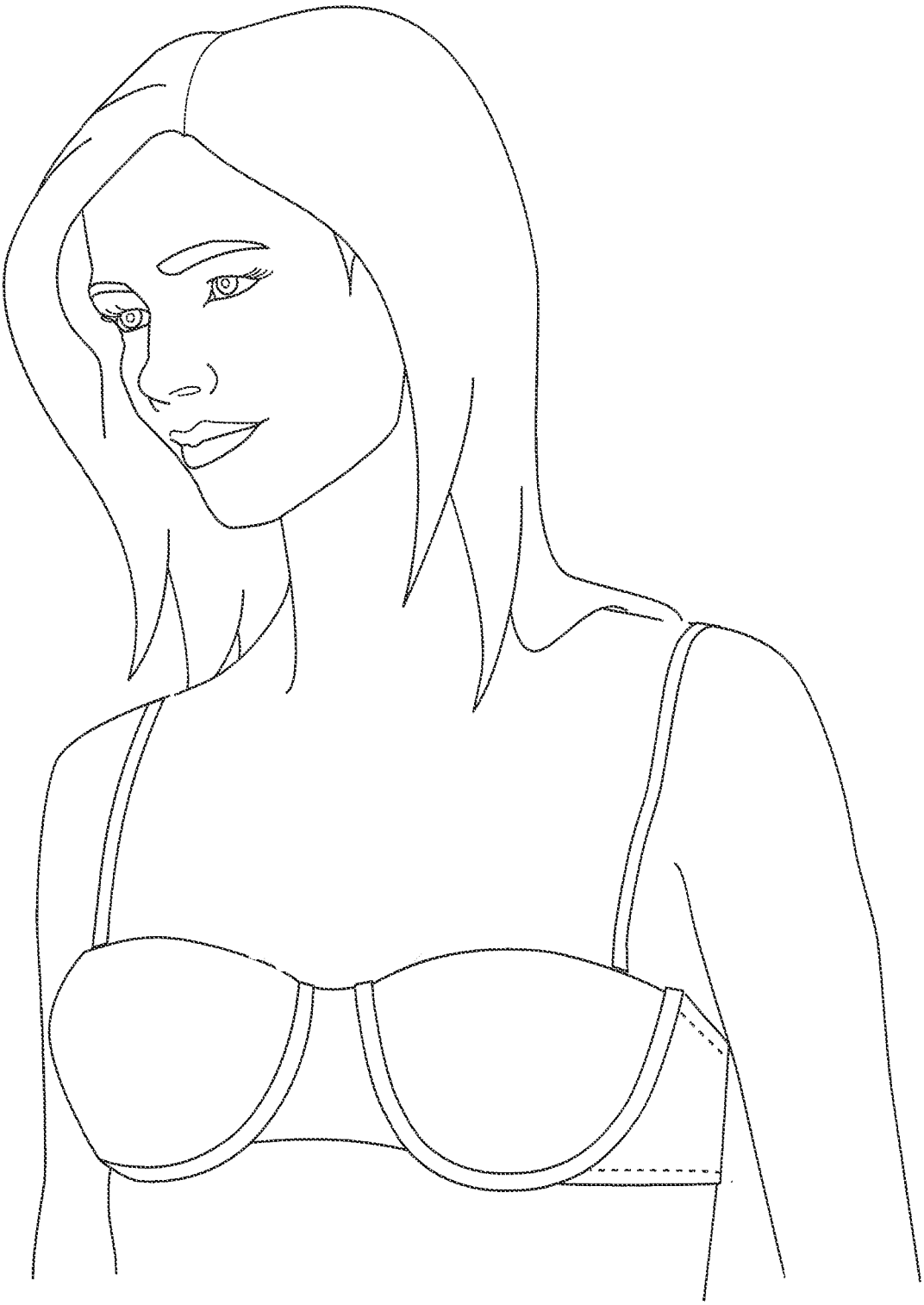
FIG. 4 is a front perspective view of a brassiere according to an embodiment of the present invention, showing an outside view of the brassiere.

As shown in FIGS. 1 and 3, the inner breast volume is smaller than the larger outer diameter. The cup is surrounded with fill to hold up the larger diameter. The wider cup has a variable inner apical zone (FIGS. 1 and 3) and outer apex (FIGS. 2 and 4). The wider cups fill in and camouflage the wide distance between the breasts for that embodiment.

Breast tissue extends laterally to the mid-axillary line and medially to the center of the chest. The mid-axillary line is considered the anatomic edge border of the breast. The breast root is the border of the breast. In the brassiere of the invention, the cup extends the boundary of the breast (breast root), differing from the present industry, which uses the breast root trace, (the inframammary fold). Thus, the brassiere of the invention gives a fullness or the illusion of fullness because the cup extends the natural anatomic border of the breast laterally, underneath and medially allowing a new method of enhancement and bra engineering and design to be obtained.

The brassiere of the invention takes into account a form of enhancement is laterally, underneath and medially. With breasts, the width can be emphasized to give the illusion of maximum volume. The extended breast root diameter enhances and supports the root in a way that has not been discussed before, and supports the breast tissue with foam (fill) which makes for a more comfortable fit. The flexibility of the foam (fill) and the larger cup enables the sizing to have greater accommodation for variations in breast size, shape and spacing. The wider breast root base allows the cup to be designed from a wider trajectory.

Because there is more wire (or wireless) cup on the body and foam (etc.) counterforcing the cups, the cups with the extended breast root diameter, is maintained on the chest wall more securely, and does not lie up onto or press against the outside of the wearers breast tissue. This makes for a more comfortably fitting brassiere and enables the engineering of the bra to work more efficiently.

The brassiere of the invention contains the breast with the cup extending further laterally, outwardly and inwardly, instead of first projecting in the forward direction as industry does. The diameter of the breast can be enhanced at the root. In the brassiere of the invention, the diameter of the arc of the cup wire (or wireless) is larger than in the current bras. A contour of greater fullness in the upper portion of the breast is created by the extension of the breast root and the extended enhancement of the lateral, lower and medial tissue.

Industry bras lift breasts that have volume up and together.

The website Her Room teaches "breast tissue is malleable. For best results, lean forward and place your breasts in your cup making sure your breast apex (nipple) is in the deepest point in your cup before fastening your bra".

In the design and manufacture of bras and bra cups, an initial design and fit decision is made about breast position, breast projection, apex position, and overall breast shape. In actuality, breast tissue is illusive with day to day, month to month variations. The industry with a close fitting cup shape does not easily allow for these variations. The current invention's larger diameters with foam (etc.) surrounding the wider perimeter is more adaptable.

The brassiere of the invention takes into account that breasts extend laterally and medially and that not all customers want to bring breasts up and together. Bringing cups closer together does not work for smaller breasts, and breasts that are augmented. We are not pushing the cups close together to create cleavage. Prior art moves cups close together and tilts them to create cleavage. This is uncomfortable for many women and it also places the underwire into the breasts in many cases. The spacing between cups should be wide enough for the gore to contact the body, which is why we have developed a new system of sizing We incorporated the spacing between the bust point location and the location of the cups on the band. By spreading out the cups and allowing the gore to sit flat against the chest wall the bra wings and cups are evenly distributed in tension and allow the bra to sit comfortably on the body.

Industry push-up bras push tissue from the sides and bottom and move the tissue to the cups. The brassiere of the invention positions the cups on the breasts and fills in the deficits. The brassiere includes pads that extend higher on the upper portion of the cup on the sides both medially and laterally, to fill in missing breast tissue and to hold up the larger cup diameter. This enables the cups (underwire, wireless etc.), gore, wings and straps (or strapless) to allow the design to work properly in tension and engineering. The inside bra cups of the brassiere of the invention are designed to contain tissue and fill (foam etc.). The fill, fills in the tissue deficits in the cup instead of relying on tissue that doesn't move, or isn't there. We build the breast from out to in first, and use fill to fill in the larger diameter.

Pendulous breasts fall down and to the side in their natural state. Industry takes them from the side, brings them to the center and lifts them up. The brassiere of the invention extends the area of the breast root by using a larger diameter for the cup than the standard diameter industry grade. Instead of moving the breast tissue toward the center of the body to create cleavage, the brassiere of the invention contains the breast tissue and the lateral, lower and medial edge of the breast is redefined. Depending on the amount of fill inside the cup, the fill can lift the breast tissue and create a globulosity of the upper portion of the breast if that is desired. This globulosity can create cleavage in a different way than pushing breast tissue together as from the sides does. The outside of the cup was created to look like a well-proportioned breast based on the outer diameter, and the inside was designed to compensate for the differences in volume, shape and sizes.

Fullness in lateral, lower and medial positions provides that the bust is supported in its natural position. This is a much more comfortable position than trying to uncomfortably move tissue. Instead of taking breast tissue and trying to push it forward, we are maximizing its appearance first by filling out the breast laterally, underneath and medially. By widening the cups (using a larger diameter and three sides of the cup with fill) we support and enhance the breast tissue in a different manner. This is more natural, and comfortable to the wearer. The mechanics of the cup act differently from setting the cup diameter tight to the breast root circumference. There is reduced pressure on the breasts because the cup is spread wider and the inner surrounding foam allows a balance of tension on the breasts and the torso.

The wider outer diameter cups and inner foam (fill) counterforce the bra.

The foam (fill) on the inside pads, make the cups more adaptable to a variety of breast shapes while also increasing the accuracy of the fit with the foams (fill) cushioning characteristic.

The wider diameter makes the engineering of the bra fit better and more comfortably.

The engineering of the bra and bra cup designed from a wider diameter and supportive fill around three sides inside, supports the breasts in a different manner.

In the prior art, the tight fitting diameter of the underwire or wireless cups has too small of a diameter to contain the breasts comfortably against the ribcage and move comfortably with the breast tissue.

The tight fit also does not allow room for variation in the cups or for differences in breast shapes and tissue distribution.

By using a tight breast root and tissue measurement as industry does, the only way to project is anteriorly.

By using a wider diameter we can project anteriorly, medially, and laterally which allows many new options for outer cup shapes including a wider projection. We emphasize width fullness first, not necessarily front projection fullness to give the illusion of volume. By using a larger (than standard) size diameter on the outside and a smaller breast volume on the inside, and fill inside this invention gives the customer new and different choices in fit and sizes.

In the brassiere of the invention, we have emphasized the width fullness, and not necessarily front projection fullness. In extending laterally, lower and medially, the tissue deficits are enhanced (built up). We enhance the lateral aspect to provide the natural curve in the natural anatomy of the breast, and not necessarily the forward projection as industry does. We defined the lateral and medial projection, which has not before been discussed or recognized, nor does the prior art recognize its importance. The outside curve provides voluptuousness without projection in the forward direction. The brassiere of the invention thus includes a different way of approaching enhancement. The assumption of the prior art bras is that to make the breast look as big as possible, front projection and cleavage must be increased since cleavage is an indication of volume. However, we are indicating that there are other indications of volume, including the outer lateral curve for lateral fullness and the medial curve. Creating cleavage by pushing the breasts together isn't necessarily the desired goal. To increase the illusion of fullness, outer lateral fullness, lower and medial fullness must first be obtained, and then, if there is enough tissue, cleavage can be provided naturally.

An embodiment of the brassiere of the invention serves breasts that are immovable. Many small breast customers and augmented customers do not have breast tissue that is easy to move and manipulate. This embodiment leaves the breast in its natural position and defines the anterior shape of the cup. We define the lateral, lower and medial shape of the cup and place the apex of the cup in the correct proportional place on the outside irrespective of the actual placement of the apex (nipple) inside the cup.

The brassiere of the invention contains the breast in a larger cup and extends the breast perimeter. Our cup is a smaller cup volume size, on the inside (i.e. 34C/d cup about 480-580 cc) and a larger size cup (and diameter) on the outside (i.e. 34D diameter about 5 inch ⅛").

The brassiere of the invention also includes pads on the upper portion of the cup that extend higher on the sides than in the prior art to fill in the deficits of the larger diameter outside cup.

The brassiere of the invention is a bra designed for the customer who does not fit comfortably into the current system of design and sizing. The brassiere was designed in response to the absence of correct fitting and correct looking bras for the women whose measurements and breast type does not conform to the current standards.

Breasts are currently described with many different variations to find a correct fit.

The website Her Room asks the customer to choose features which best describe their breasts to determine a bra that has the best fit for them.

There are variations in breast spacing (touching, separated, splayed, wide set, and wide set splayed). There are variations in shape (conical, thin, omega), variations in upper breast fullness (full, semi full, shallow, deflated) and variations in breast position (self-supporting, semi supported, settled, pendulous) as an example.

The suggested solution for "outward pointing nipples" is to find a bra designed with closer apex points, wide support panels, arched center support, and/or narrow center panels. The suggested solutions for "thin breasts" are bandeau bras, push up bras, breast enhancers and contour cup bras.

The sizing of the present invention is based on proportion. The cups are made up of an inside criteria and an outside criteria. Each criteria has a separate function.

Our outside 34C diameter cup has an inside accommodation for between 390-470 cc volume and is called 34B/c.

Our outside 34A diameter cup has an inside accommodation for less than 310 cc volume and is called 34AA/a.

Our outside 34B diameter cup has an inside accommodation for between 310-380 cc volume and is called 34A/b.

Our outside 34C diameter cup has an inside accommodation for between 390-470 cc volume and is called 34B/c.

Our outside 34D diameter cup has an inside accommodation for between 480-580 cc and is called 34C/d.

Our outside 34E diameter cup has an inside accommodation for between 590-700 cc and is called 34D/e.

Our outside 34B diameter double fill cup has an inside accommodation for less than 310 cc volume and is called 34AA/b.

Our outside 34C diameter double fill cup has an inside accommodation for between 310-380 cc volume and is called 34A/c.

Our outside 34D diameter double fill cup has an inside accommodation for between 390-470 cc volume and is called 34B/d.

Our outside 34E diameter double fill cup has an inside accommodation for between 480-580 cc volume and is called 34C/e.

Our outside 34EE diameter double fill cup has an inside accommodation for between 590-700 cc volume and is called 34D/ee.

As shown in FIGS. 3 and 4 in an embodiment, the cup spacing, or gore, is different from that in the prior art. Our cups for small and augmented breasts are spaced wider apart to accommodate immovable tissue. This allows the cups to be properly positioned on the breasts. It also allows the gore to sit flat on the chest wall and allow the engineering of the bra to work properly. Our sizing for that embodiment recognizes the differences in bust point location on the body and is called 1, and 2.

The sizes are listed below:

Size 1=6½" and less than 6½" bust point spacing

Size 2=6½" and greater than 6½" bust point spacing (Bust point spacing is measured from apex to apex)

Band size—26, 28, 30, 32, 34, 36, 38, 40 (measured according to industry)

(Band sizes may be combined ie 26/28, 30/32, 34/36, 38/40)

Cup sizes—AA/a, A/b, B/c, C/d, D/e, E/ee (inner volume measured according to industry)

The AA/a (AA inside/a outside) measures inside volume <1" highpoint projected from chest wall with inside fill to compensate for outside diameter equivalent to industry (A) breast root measurement underwire and our sculpted outside cup. The AA/b (AA inside/b outside) measures inside volume about <1" highpoint projected from chest wall with inside fill to compensate for outside diameter equivalent to industry (B) breast root measurement underwire, and inside fill equivalent to a volume between an (AA) and a (A) projected from chest wall and a volume between an (A) and a (B) sculpted outside cup.

The A/b (A inside/b outside) measures inside volume about 1" highpoint projected from chest wall with inside fill to compensate for outside diameter equivalent to industry (B) breast root measurement underwire and our sculpted outside. The A/c (A inside/c outside) measures inside volume about 1" highpoint projected from chest wall with inside fill to compensate for outside diameter equivalent to industry (C) breast root measurement underwire, and inside fill equivalent to a volume between a (A) and a (B) projected from chest wall and a volume between a (B) and a (C) sculpted outside cup.

The B/c (B inside/c outside) measures inside volume about 2" highpoint projected from chest wall with inside fill to compensate for outside diameter equivalent to industry (C) breast root measurement underwire and our sculpted outside. The B/d (B inside/d outside) measures inside volume about 2" highpoint projected from chest wall with inside fill to compensate for outside diameter equivalent to industry (D) breast root measurement underwire, and inside fill equivalent to a volume between a (B) and a (C) projected from chest wall and a volume between a (C) and a (D) sculpted outside cup.

The C/d (C inside/d outside) measures inside volume about 3" highpoint projected from chest wall with inside fill to compensate for outside diameter equivalent to industry (D) breast root measurement underwire and our sculpted outside. The C/e (C inside/e outside) measures inside volume about 3" highpoint projected from chest wall with inside fill to compensate for outside diameter equivalent to industry (E) breast root measurement underwire, and inside fill equivalent to a volume between a (C) and a (D) projected from chest wall and a volume between a (D) and a (E) sculpted outside cup.

The D/e (D inside/e outside) measures inside volume about 4" highpoint projected from chest wall with inside fill to compensate for outside diameter equivalent to industry (E) breast root measurement underwire and our sculpted outside. The D/ee (D inside/ee outside) measures inside volume about 4" highpoint projected from chest wall with inside fill to compensate for outside diameter equivalent to industry (EE) breast root measurement underwire, and inside fill equivalent to a volume between a (D) and a (E) projected from chest wall and a volume between a (E) and a (EE) sculpted outside cup.

The industry assigns the (C) projection as 3" from the chest wall and (B) projection as 2" from the chest wall. The B/c cup of this invention is about 2½"-2¾" projected from the chest wall as the projection of the fill is spread wider than industry. The AA/a projects about 1" from the chest wall. The A/b cup projects about 1½"-1¾" from the chest wall. The B/c cup projects about 2½"-2¾" from the chest wall. The C/d cup projects about 3½"-3¾" from the chest wall. The D/e cup projects about 4½"-4¾" from the chest wall.

The double fill A/c is about 2½"-2¾" projected from the chest wall as the projection of the fill is spread wider than industry. The AA/b double fill cup projects about 1½"-1¾" from the chest wall. The A/c double fill cup projects about 2½"-2¾" from the chest wall. The B/d double fill cup projects about 3½"-3¾" from the chest wall. The C/e double fill cup projects about 4½"-4¾" from the chest wall. The D/ee double fill cup projects about 5½"-5¾" from the chest wall.

| | | | | | |
|---|---|---|---|---|---|
| 26AA/a1 | 26A/b1 | 26B/c1 | 26C/d1 | 26D/e1 | 26E/ee1 |
| 28AA/a1 | 28A/b1 | 28B/c1 | 28C/d1 | 28D/e1 | 28E/ee1 |
| 30AA/a1 | 30A/b1 | 30B/c1 | 30C/d1 | 30D/e1 | 30E/ee1 |
| 32AA/a1 | 32A/b1 | 32B/c1 | 32C/d1 | 32D/e1 | 32E/ee1 |
| 34AA/a1 | 34A/b1 | 34B/c1 | 34C/d1 | 34D/e1 | 34E/ee1 |
| 36AA/a1 | 36A/b1 | 36B/c1 | 36C/d1 | 36D/e1 | 36E/ee1 |
| 38AA/a1 | 38A/b1 | 38B/c1 | 38C/d1 | 38D/e1 | 38E/ee1 |
| 40AA/a1 | 40A/b1 | 40B/c1 | 40C/d1 | 40D/e1 | 40E/ee1 |

Sizing may be, but not limited to:

| | | | | | |
|---|---|---|---|---|---|
| 26AA/a | 26A/b | 26B/c | 26C/d | 26D/e | 26E/ee |
| 28AA/a | 28A/b | 28B/c | 28C/d | 28D/e | 28E/ee |
| 30AA/a | 30A/b | 30B/c | 30C/d | 30D/e | 30E/ee |
| 32AA/a | 32A/b | 32B/c | 32C/d | 32D/e | 32E/ee |
| 34AA/a | 34A/b | 34B/c | 34C/d | 34D/e | 34E/ee |

-continued

| | | | | | |
|---|---|---|---|---|---|
| 36AA/a | 36A/b | 36B/c | 36C/d | 36D/e | 36E/ee |
| 38AA/a | 38A/b | 38B/c | 38C/d | 38D/e | 38E/ee |
| 40AA/a | 40A/b | 40B/c | 40C/d | 40D/e | 40E/ee |

| | | | | |
|---|---|---|---|---|
| 26AA/b | 26A/c | 26B/d | 26C/e | 26D/ee |
| 28AA/b | 28A/c | 28B/d | 28C/e | 28D/ee |
| 30AA/b | 30A/c | 30B/d | 30C/e | 30D/ee |
| 32AA/b | 32A/c | 32B/d | 32C/e | 32D/ee |
| 34AA/b | 34A/c | 34B/d | 34C/e | 34D/ee |
| 36AA/b | 36A/c | 36B/d | 36C/e | 36D/ee |
| 38AA/b | 38A/c | 38B/d | 38C/e | 38D/ee |
| 40AA/b | 40A/c | 40B/d | 40C/e | 40D/ee |

| | | | | | |
|---|---|---|---|---|---|
| 26AA/a2 | 26A/b2 | 26B/c2 | 26C/d2 | 26D/e2 | 26E/ee2 |
| 28AA/a2 | 28A/b2 | 28B/c2 | 28C/d2 | 28D/e2 | 28E/ee2 |
| 30AA/a2 | 30A/b2 | 30B/c2 | 30C/d2 | 30D/e2 | 30E/ee2 |
| 32AA/a2 | 32A/b2 | 32B/c2 | 32C/d2 | 32D/e2 | 32E/ee2 |
| 34AA/a2 | 34A/b2 | 34B/c2 | 34C/d2 | 34D/e2 | 34E/ee2 |
| 36AA/a2 | 36A/b2 | 36B/c2 | 36C/d2 | 36D/e2 | 36E/ee2 |
| 38AA/a2 | 38A/b2 | 38B/c2 | 38C/d2 | 38D/e2 | 38E/ee2 |
| 40AA/a2 | 40A/b2 | 40B/c2 | 40C/d2 | 40D/e2 | 40E/ee2 |

For example, for size 32AA/a1, 32 is the ribcage measurement, (measured according to industry). AA is the breast tissue volume of (<1") according to industry calculation. a is the outer diameter. 1 is the location of the bust point spacing (6½" or less) (as an example for that embodiment). The grade of the outside cup will be based on the anatomical correct proportion of the breast based on the ribcage measurement. The grade of the inside cup will be based on the amount of breast tissue volume and the amount of fill required to support the outside cup diameter.

According to Dr. Pechters "Chart for Determining Your Breast/Bra Size" an underbust circumference measuring 29" is equivalent to a 34 band size. A breast width measuring 6" and 6.5" with a 29" underbust circumference is considered a 34A. A breast width measurement of 7" and 7.5" on the same band measurement is considered a B, a breast width measurement of 8" and 8.5" is considered a C, etc.

According to Dr. Pechter's, "Chart for Determining Your Breast/Bra Size" in the current invention a 34C/d would have an inside accommodation for about an 8"-8¾" breast width (C cup) and an outside diameter of about 5 inch ⅙ (13.1 cm) which is equivalent to a D cup diameter (between a 9" and a 9¾" outer cup width). A 34C/e would have an inside accommodation for about an 8"-8¾" breast width (C cup) and an outside diameter of about 5 inch ⅚ (14.8 cm) which is equivalent to an E cup diameter (between a 10-10¾" outer cup width).

The cups of the brassiere of the invention were also designed to create the appearance of a fuller, wider bust for augmented breasts. The cups are a hybrid. That is, the cups are comprised of a variation of a C volume sized and sculpted outer cup with a variation of a B volume sized and sculpted inner cup. The inside is designed and created to fill in the areas that the B bust is missing due to its augmented shape and to hold up and fill out the larger outer shell of the cup.

Figure 15:
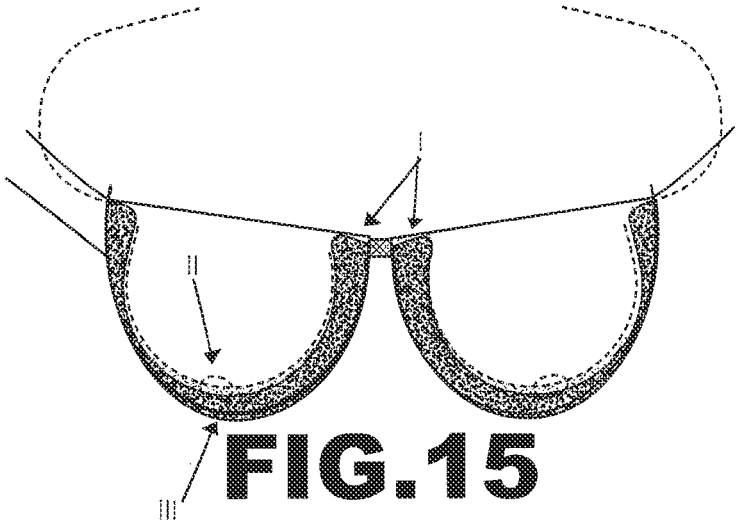
FIG. 15 is a schematic diagram of an embodiment of the invention for augmented breasts showing the inside cup and fill around the medial, lower and lateral side of the breast with a greater amount of fill on the medial side.

The outside of the cup is sculpted to have a simulated look of a weighted bust and the apex of the bust is placed in a proper position separate and apart from the at rest position of the apex positioned in the inside cup. For example, the natural bust point spread of a B bust might be 8". We designed the inside cup to be placed on the bust in its natural resting position inside and we designed the outside B/c cup to have the most desired B/c cup shape irrespective of the inside sitting position and bust point spread. In other words, we created the outside look first, and then built the inside to properly accommodate the bust, and vice versa. See particularly FIGS. 15 and 16.

Calculating Cup Volume and Breast Weight:

The average breast weighs about 0.5 kg (1.1 lb). Each breast contributes to about 4%-5% of the body fat.

The density of fatty tissue is more or less equal to 0.9 kg/l for all women. The volume of a woman's individual breasts can vary. Bra designers can give it the shape of a hemisphere or a hemi-spheroid by fitting it into a cup. If the bust is considered essentially a half sphere, its volume V is determined by the following formula:

$$V=2\pi^3/3 \quad V=2.1\times r^3 \quad V=0.26\times D^3$$

Where D is the diameter of the sphere and r is the radius of the sphere.

If the breast is shaped more like a spheroid, the designer might use the formula like the following:

$$V=0.26\times D^2/b\times h$$

Where b equals diameter of the hemispheroid's base and h equals the height of the spheroid.

Other formulas can be derived as needed to design bras for differently shaped breasts. All of these formulas assume that the breasts conform to the mentioned mathematical model.

Cups give a hemispherical shape to the breast, and underwires give shape to the cups. So the curvature radius of the underwire is key to determine volume and weight of the breast. The same underwires are used for the cups of sizes 36A, 34B, 32C, 30D, and etc., so these cups have the same volume. The reference numbers of underwire sizes are based on a B cup bra, for example, underwire size 32 is for 32B cup (and 34A, 30C, . . . ). An underwire size 30 width has a curvature diameter of 3⅝=9.7 cm and this diameter increases by ⅓ in=0.847 cm by size. 27

The table below shows volume calculations for some cups that can be found in ready to wear large size shop.

| Underwire size | Bra size (US system) | Cup Diameter | Volume of one cup | Weight |
|---|---|---|---|---|
| 30 | 32A, 30B, 28C | 9.7 cm (3 5/6 in) | 240 cc (0.51 US pt) | 0.43 kg |
| 32 | 34A, 32B, 30C, 28D | 10.6 cm (4 1/6 in) | 310 cc (0.66 US pt) | 0.56 kg |
| 34 | 36A, 34B, 32C, 30D | 11.4 cm (4 1/2 in) | 390 cc (0.82 US pt | 0.70 kg |
| 36 | 38A, 36B, 34C, 32D | 12.3 cm (4 5/6 in) | 480 cc (1.0 US pt) | 0.86 kg |

By using the above chart based on the volume of a 34A cup (310 cc) and a 34B cup (390 cc) we are filling the invention for a 34A/b cup with approximately the equivalent of about 80 cc of foam which is the difference between the volume of a standard industry A cup and a standard industry B cup. For a 34A/c cup (310 cc and 480 cc) we are filling the invention with approximately the equivalent of about 170 cc of foam which is the difference between the volume of a standard industry A cup and a standard industry C cup.

The cup diameter we are using is equivalent to approximately a 34B (11.4 cm=4½ in) according to the above chart for our 34A/b bra which according to the above chart industry uses 10.6 cm (4⅙ in) for an A cup. For a 34A/c cup diameter according to the above chart, we are using approximately the equivalent to a 34C (12.3 cm=4⅝ in.) for our 34A/c.

We are using dimensions of a 34B diameter for our 34A bras and filling in the deficits in circumference and volume with fill. The foam (fill) is built up on the inside to fill in the breast tissue deficit, and the cup is designed on the outside to make the cup look like it has the weight and volume of a B cup. We put the exterior bust point location on what would have been a 34B diameter and we made the appearance in the cup look like it has the weight of a 34B volume. We made what normally would be a 34B cup into an A cup using a B wire or diameter and spread the cup wider so there is more width in the cup on the body. The location that the cup sits on the body is integral to a correct fit.

Industry bras shape the breast and manipulate tissue. Our invention does not necessarily use the breast inside to affect the shape on the outside. We are not molding the breasts per se, we are designing the cups externally and filling the inside cup to accommodate and surround the larger diameter. In one embodiment, the inside fill around the diameter may be a separate insert placed inside the cup between the breast tissue, breast root and larger diameter. The insert may be put into a sleeve, a pocket, a channel. The insert may be a separate attachment.

In the prior art, the tight fitting diameter of the underwire or wireless cups has too small of a diameter to contain the breasts comfortably against the ribcage and move comfortably with the breast tissue. The tight fit also does not allow room for variation in the cups or for differences in breast shapes and tissue distribution By using a larger (than standard) size diameter on the outside and a smaller breast volume on the inside, and fill inside this invention gives the customer new and different choices in fit and sizes.

This invention does not need to have precise measurements.

The foam (fill) is adaptable to variations on the inside, and outside shape, and is not necessarily dependent on the inside tissue. There is room built in for error in measurement and also variation.

The wearer's body doesn't have to be exactly like the original "core" form. Because the apical zone has more area to accommodate the breast, it doesn't have to fit into the cup in the same manner as the outside shape. The outside shape acts to a degree, independently from the inside.

From the website Beauty Lies Beneath, under the heading "Finding your bra size":

| Difference | Standard Cup Size |
|---|---|
| 0"-1/2" (1.3 cm) | AA |
| 1/2"-1" (2.6 cm) | A |
| 1"-2" (5.1 cm) | B |
| 2"-3" (7.6 cm) | C |

According to this chart, we use about the difference between an A cup (2.6 cm) and a B cup (5.1 cm) to fill the diameter of the B cup measurements we are using for our A/b cup. We use about the difference between an A cup (2.6 cm) and a C (cup) (7.6 cm) to fill the diameter of the C cup measurements we are using for our A/c.

A goal of the brassiere of the invention is to maximize the look of the existing bust using larger wider sized diameters and cups outside, and fill inside around the sides, to create a comfortable and well-fitting bra by creating a counter force between the bust, the cups, and the wings using foam (fill)

to counter balance the cups and to give the illusion of weight and mass. Special tension engineering was used to make the bra fit comfortably without pressing the bust to the pads or the body. And to give the nonstandard size customer a wide range of designs accommodating variations of size, shape and spacing.

The brassiere of the invention also has a line of swim wear and exercise wear taking these same needs into account. In some embodiments the invention may be used as a separate top (straps, strapless, etc.), as a combination with the swim or exercise wear, or as cups sewn into the garments, as inserts etc.

Another embodiment of this invention is for augmented breasts.

By using a larger diameter and filling the cups medially, laterally and underneath we are able to change the exterior look of breast implants. Augmented breasts have a smaller base diameter (see FIG. 15) and get fuller with the width of the implant. We support the base of the implant with foam (fill) around the implant between the implant and the torso. This is a much more effective means of support and comfort Because we design the outside cup with a larger diameter we are able to weight the outside of the cup giving it a more natural lower weight and disguise the unnatural hemisphere that the implants create.

The larger cups extend medially (see FIG. 15 I) and can disguise the large gap many women have between the breasts. This also enables the gore to sit flat on the chest making the bra function properly By having an inside volume and outside volume and placing the cups on the breasts without pushing them together and sculpting the outside apex (see FIG. 15 III) irrespective of the inside apex (see FIG. 15 II) we are able to create a natural apex placement on the outside and sculpt the apex inside to sit the breast comfortably in the cup.

The sizing for this bra may be based on bust point measurements. Size 1 is a bust point spread of 6½" and smaller. Size 2 is a bust point spread of 6½" and wider.

The sizing of the present invention is based on proportion. The cups are made up of an inside criteria and outside criteria. Each criteria has a separate function.

Figure 16:
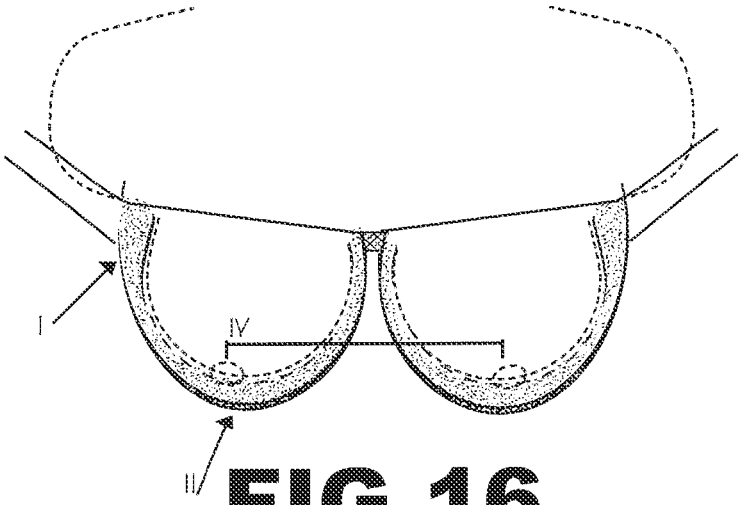
FIG. 16 is a schematic diagram of an embodiment of the invention for augmented breasts showing the inside cup and fill around the medial, lower and lateral side of the breast with a greater amount of fill on the lateral side
Figure 17:
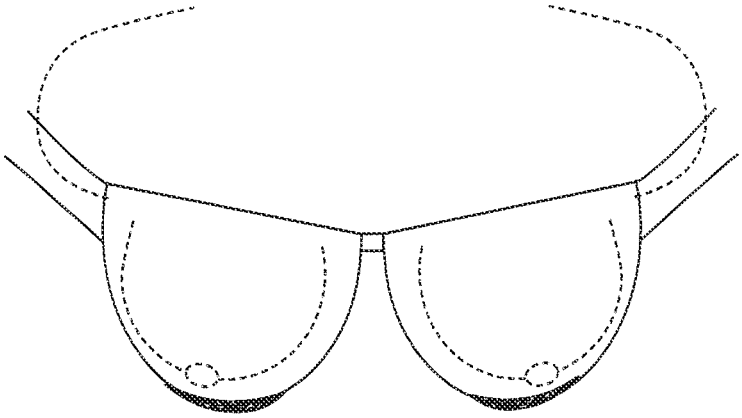
FIG. 17 is a schematic diagram of an embodiment of the invention for augmented breasts showing the outside cup shape with a wider breast root diameter, and the location of the cup outer apex spaced medially from the inner cup apex and the breast point.
Figure 18:
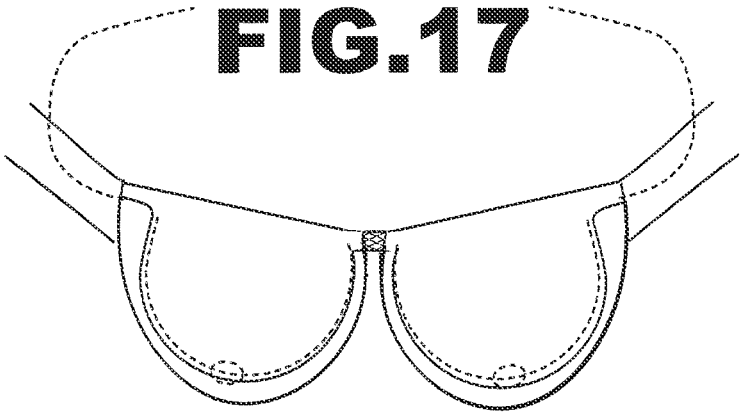
FIG. 18 is a schematic diagram of an embodiment of the invention for augmented breasts showing the inside cup shape with a wider breast root diameter, and a wider apical zone.
Figure 19:
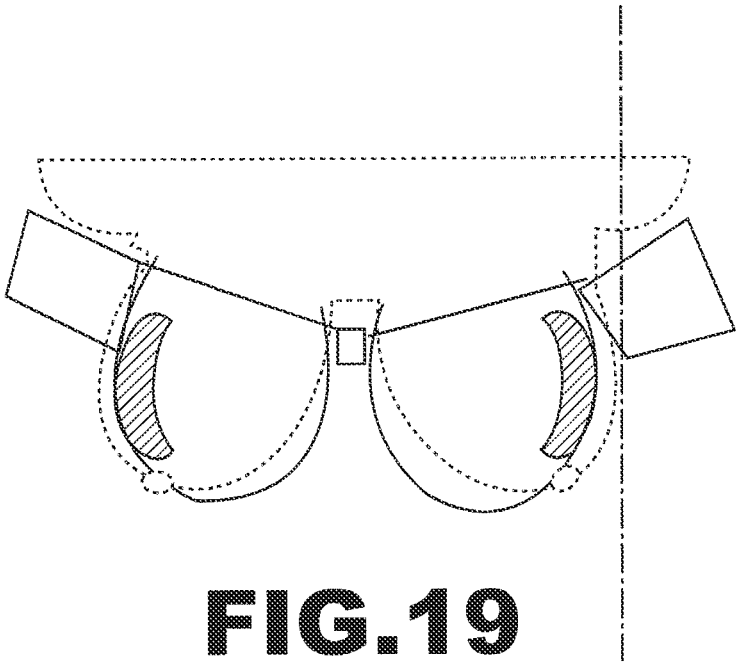
FIG.19 PRIOR ART
FIG. 19 is a schematic diagram of larger size pendulous breasts in a natural position and showing a superimposed brassiere.
Figure 20:
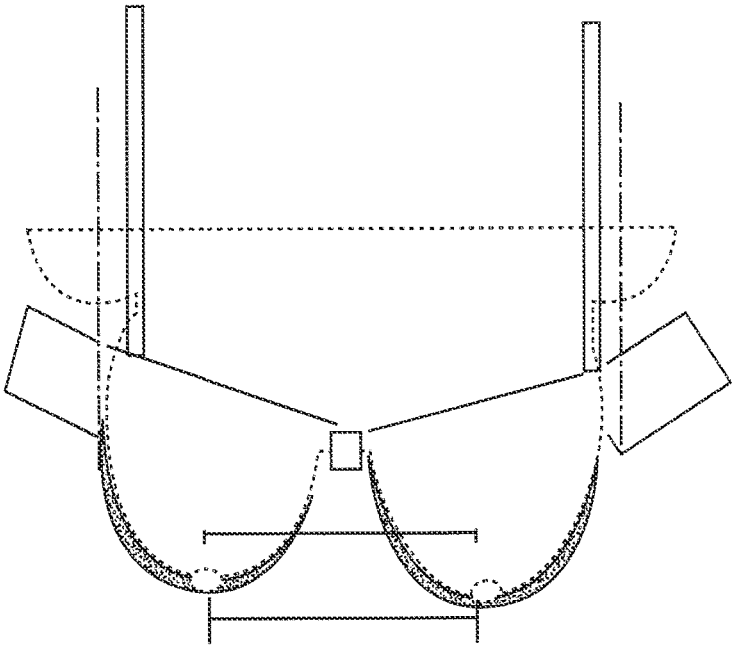
FIG.20 PRIOR ART
FIG. 20 is a schematic diagram of larger size pendulous breasts contained in a brassiere, showing that the breast points have been moved toward each other for the breast to be contained in the brassiere.

By using a larger diameter than standard per size and enhancing the cups medially, laterally and underneath we are able to accommodate and hide the obvious tell-tale signs of augmented breasts. By using a system of bust point spacing (see FIG. 16 IV) we are able to leave the relatively immovable breast in place and allow the gore to touch the body making for a more comfortable and functional bra. By using wider cup diameters and filling the inside with foam (fill) we are able to camouflage the hemispheric shape of the implant (see FIGS. 15 and 16) and give the bust more support on the inside (FIG. 16 I), and a more natural shape on the outside (FIG. 16 II)

By using a wider diameter on the outside of the cup, we are able to create a wider variety of shapes (i.e, spheroid, oblate spheroid, hemisphere, etc.) on the outside.

Figure 11:
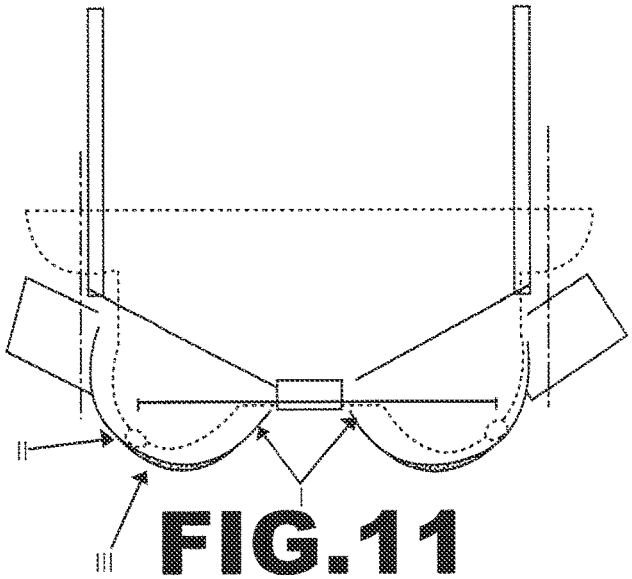
FIG. 11 is an schematic diagram of the brassiere of the invention showing the outside cup shape with a wider breast root diameter, and the location of the cup outer apex spaced medially from the inner cup apex and the bust point.
Figure 12:
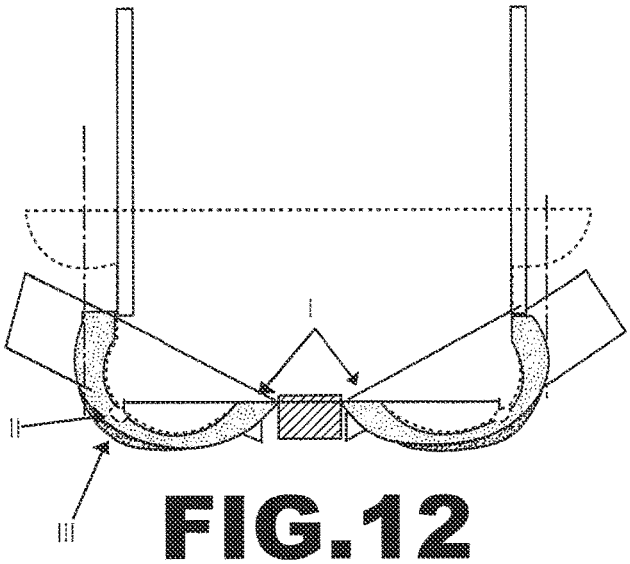
FIG. 12 is a schematic diagram of the brassiere of the invention showing the inside cup shape with a wider breast root diameter, inside fill surrounding the breast and the location of the cup outer apex spaced medially from the inner cup apex and the bust point.
Figure 13:
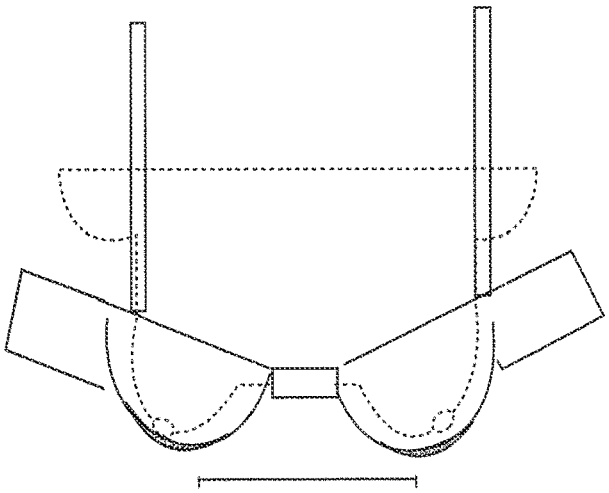
FIG. 13 is a schematic diagram of an embodiment of the brassiere of the invention showing the spheroid inside cup shape with a wider breast root diameter, and the location of the cup outer apex spaced medially from the inner cup apex and the bust point.
Figure 14:
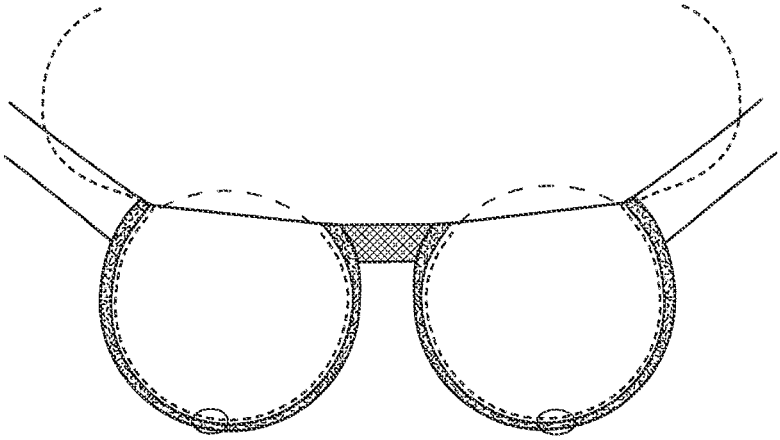
FIG.14 PRIOR ART
FIG. 14 is a schematic diagram of a brassiere from prior art showing the cup shape for augmented breasts.

Additionally, by using a wider diameter than standard per volume size, (see FIGS. 15 and 16) and a system of bust point spacing, (FIG. 16 IV), an external apex sculpturally placed on the outside of the cup (FIG. 15 III) irrespective of the actual apex placement inside (FIG. 15 II), and a wider inner apical zone inside, we are better able to accommodate a greater variety of breasts that are immovable (see FIG. 11). FIG. 11 (I) shows a wider diameter with medial fill, FIG. 11 (II) shows inside apex placement, FIG. 11 (III) shows outer cup apex. FIG. 12 (I) shows inside fill inside a wider diameter, FIG. 12 (II) shows inside apex placement, FIG. 12 (III) shows an outer cup apex. By using fill inside and outside the larger diameter we are better able to accommodate and support a greater variety of breast shapes and sizes (see FIG. 13).

Women can have moderate sized implants and use our bras to increase the size by one or two sizes because the inner volume is separate from the outer cup size Because the inner foam (fill) surrounds the augmented breasts it counterforces the bra against the torso taking tension off of the breasts. The foam (fill) supports the bra and balances the breasts, cups and torso to counterforce the bra. This is a much more comfortable fit as it surrounds the breasts with foam (fill).

The design of the invention has a wider apical zone giving the nipple (apex) more room and alleviates the pressure on the nipple (apex). It can also disguise the forward pointing nipples (greater anterior projection than natural breasts) that augmentation creates.

Implants come in two shapes—round and teardrop.

Profile refers to an implants width and forward projection: the narrower the implant the more it projects. The implant profile is selected according to the width of your breast, which is measured during the consultation. If you have a larger frame and wider breasts, lower or medium profile implants will better conform to your shape. If you have a small frame, you might be a candidate for higher profile implants, the narrowest of all.

The brassiere of this invention disguises the implant on the outside while surrounding it and cushioning it with foam (fill) around the inside. Our cup is smaller on the inside and a larger cup and diameter on the outside. The invention provides a bra that makes the augmented breasts look anatomically correct.

The brassiere of the invention includes pads that extend laterally, underneath and medially. The brassiere of the invention also includes pads on the upper portion of the cup that extend higher than in the prior art to fill in the deficits of the wider diameter.

NON-LIMITING EXAMPLES

An exemplary brassiere is shown in FIGS. 1-2, 5 and 15, which shows a brassiere 1 that includes first and second wings 2. A first closure portion 6 is arranged on the first end of the first wing and second closure portion 6 arranged on the first end of the second wing.

A first left-side cup 3 includes a medial side (side adjacent the gore 4 and on one side of the apex 8) and a lateral side (opposite side of apex 8) connected to the second end of the first wing 2. An inner contour defines a cup volume and an outer contour defines a volume larger than the cup volume. The first left-side cup has a first cup perimeter. The first cup perimeter includes a curved bottom and a non-circular curved top. The curved bottom has a middle curved portion C as well as a medial portion B and a lateral portion D and these have less curvature and are arranged on opposite sides of the middle curved portion C. The non-circular curved top has a middle curved portion H as well as a medial portion G and a lateral portion I and these have less curvature and are arranged on opposite sides of the middle curved portion H. The middle curved portion H of the non-circular curved top has less curvature than the middle curved portion C of the curved bottom. A fill material 10 extends to both the medial side and to the lateral side of the first left-side cup 3 and is disposed between the inner contour and the outer contour. The fill material 10 has a non-circular curved bottom FB and an inwardly curved portion IC disposed on an upper end between two upward projecting portions PP. The two upward projecting portions PP are closer to the non-circular curved top than to the curved bottom. A thickness of the fill material 10 is greater on the medial side of the first cup than on the lateral side of the first cup (see FIG. 15) or vice versa (see FIG. 16). A medial end A of the curved bottom extends to a medial end F of the non-circular curved top.

A second right-side cup is similarly configured (and will be described with the same reference numbers as the left-side cup) includes a medial side (side closer to the gore 4) and a lateral side connected to the second end of the second wing 2.

An inner contour defines a cup volume and an outer contour defines a volume larger than the cup volume. The second right-side cup has a second cup perimeter. The second cup perimeter includes a curved bottom and a non-circular curved top. The curved bottom has a middle curved portion C as well as a medial portion B and a lateral portion D and these have less curvature and are arranged on opposite sides of the middle curved portion C. The non-circular curved top has a middle curved portion H as well as a medial portion G and a lateral portion I and these have less curvature and are arranged on opposite sides of the middle curved portion H. The middle curved portion H of the non-circular curved top has less curvature than the middle curved portion C of the curved bottom. A fill material 10 extends to both the medial side and to the lateral side and is disposed between the inner contour and the outer contour. The fill material 10 has a non-circular curved bottom FB and an inwardly curved portion IC disposed on an upper end between two upward projecting portions PP. The two upward projecting portions PP are closer to the non-circular curved top than to the curved bottom. A thickness of the fill material 10 is greater on the medial side of the second right-side cup 3 than on the lateral side of the second cup 3 or vice versa. A medial end A of the curved bottom extends to a medial end F of the non-circular curved top. A gore 4 has one end connected to the medial side of the first cup 3 and an opposite end connected to the medial side of the second cup 3. A first strap 5 is connected to the non-circular curved top of the first cup 3. A second strap 5 is connected to the non-circular curved top of the second cup 3.

The first cup perimeter can also include a lateral side portion L having a lower end M extending to a lateral end E of the curved bottom and an upper end K extending to a lateral end J of the non-circular curved top. The lateral side portion L and the lateral portion D of the non-circular curved bottom can form an L-shaped lateral edge of the first cup 3. The second cup perimeter can also include a lateral side portion L having a lower end M extending to a lateral end E of the curved bottom and an upper end K extending to a lateral end J of the non-circular curved top. The lateral side portion L and the lateral portion D of the non-circular curved bottom can form an L-shaped lateral edge of the second cup 3.

Another exemplary brassiere is shown in FIGS. 3 and 4, which shows a brassiere 1' that includes, among other things, a C-shaped fill 10'.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A brassiere, in an unworn state, comprising:

a first wing having a first end and a second end;

a second wing having a first end and a second end;

a first closure portion arranged on the first end of the first wing;

a second closure portion arranged on the first end of the second wing;

a first cup comprising:

a medial side;

a lateral side connected to the second end of the first wing;

an inner contour defining a cup volume and a first area;

an outer contour defining a volume larger than the cup volume and having a first cup perimeter;

said first cup perimeter including an inwardly curved bottom having a varying radius of curvature and a curved top having a varying radius of curvature;

said inwardly curved bottom including a middle inwardly curved portion as well as medial and lateral inwardly curved portions with greater radius of curvature than the middle inwardly curved portion and arranged on opposite sides of the middle inwardly curved portion;

the middle inwardly curved portion having a smaller radius of curvature than the curved top;

a fill material extending to both the medial side and to the lateral side and defining an area, when viewed from a rear side, that is greater than half of the first area;

said fill material being U-shaped and having:

an inwardly curved bottom perimeter having a varying radius of curvature;

an inwardly curved indentation being spaced from an apex of the first cup so as to extend below the apex of the first cup; and upper lateral and medial spaced apart ends extending above the apex of the first cup and positioned closer to the curved top of said first cup perimeter than to the apex of the first cup; and a width of the fill material being different on the medial side of the first cup than on the lateral side of the first cup;

a curvature of the inwardly curved indentation of the fill material being different than the varying radius of curvature of the inwardly curved bottom of the first cup perimeter;

a second cup comprising:

a medial side;

a lateral side connected to the second end of the second wing;

an inner contour defining a cup volume and a second area;

an outer contour defining a volume larger than the cup volume and having a second cup perimeter;

said second cup perimeter including an inwardly curved bottom having a varying radius of curvature and a curved top having a varying radius of curvature;

said inwardly curved bottom including a middle inwardly curved portion as well as medial and lateral inwardly curved portions with greater radius of curvature than the middle inwardly curved portion and arranged on opposite sides of the middle inwardly curved portion;

the middle inwardly curved portion having a smaller radius of curvature than the curved top;

a fill material extending to both the medial side and to the lateral side and defining an area, when viewed from a rear side, that is greater than half of the second area;

said fill material being U-shaped and having:

an inwardly curved bottom perimeter having a varying radius of curvature;

an inwardly curved indentation being spaced from an apex of the second cup so as to extend below the apex of the second cup; and upper lateral and medial spaced apart ends extending above the apex of the second cup and positioned closer to the curved top of said second cup perimeter than to the apex of the second cup;

a width of the fill material being different on the medial side of the second cup than on the lateral side of the second cup; and a curvature of the inwardly curved indentation of the fill material being different than the varying radius of curvature of the inwardly curved bottom of the second cup perimeter, wherein, in the unworn state, the first and second wings extend out and away from the respective first and second cups and are separated from one another so that the first and second closure portions extend in opposite directions.

2. The brassiere of claim 1, further comprising:

a first strap having a first end connected to the curved top of the first cup;

a second strap having a first end connected to the curved top of the second cup; and a gore having greater length than width.

3. The brassiere of claim 1, wherein each middle inwardly curved portion has a lowermost edge that is located below a lower end of a gore connected to the first and second cups.

4. The brassiere of claim 1, wherein each middle inwardly curved portion has a lowermost edge that is located below a lower end of the first and second wings.

5. The brassiere of claim 1, wherein the cup volume of each inner contour is less than 310 cubic centimeters (cc) and a diameter of the outer contour is 4 and ⅙ inches.

6. The brassiere of claim 1, wherein the cup volume of each inner contour is between 310-380 cc and a diameter of the outer contour is 4 and ½ inches.

7. The brassiere of claim 1, wherein the cup volume of each inner contour is between 390-470 cc and a diameter of the outer contour is 4 and ⅚ inches.

8. The brassiere of claim 1, wherein the cup volume of each inner contour is between 480-580 cc and a diameter of the outer contour is 5 and ⅙ inches.

9. The brassiere of claim 1, wherein the cup volume of each inner contour is between 590-700 cc and a diameter of the outer contour is 5 and ½ inches.

10. The brassiere of claim 1, wherein the cup volume of each inner contour is between 710-850 cc and a diameter of the outer contour is 5 and ⅚ inches.

11. The brassiere of claim 1, wherein each fill material is foam.

12. A brassiere, in an unworn state, comprising:

a first wing having a first end and a second end;

a second wing having a first end and a second end;

a first closure portion arranged on the first end of the first wing;

a second closure portion arranged on the first end of the second wing;

a first cup comprising:

a medial side;

a lateral side connected to the second end of the first wing;

an inner contour defining a first area and a cup volume;

an outer contour defining a volume larger than the cup volume and having a first cup perimeter;

said first cup perimeter including an inwardly curved bottom having a varying radius of curvature and an inwardly curved top having a varying radius of curvature;

said inwardly curved bottom having a middle inwardly curved portion as well as medial and lateral inwardly curved portions with greater radius of curvature than the middle inwardly curved portion and arranged on opposite sides of the middle inwardly curved portion;

a fill material extending to both the medial side and to the lateral side and being disposed between the inner contour and the outer contour;

said fill material being curve-shaped and defining an area, when viewed from a rear side, that is greater than half of the first area; said fill material comprising:

an inwardly curved bottom perimeter with a varying radius of curvature;

an inwardly curved indentation disposed on an upper end of the fill material and being spaced from an apex of the first cup so as to extend below the apex of the first cup; and upper lateral and medial spaced apart ends of said curve-shaped fill material spaced from and extending above the apex of the first cup and being spaced from the inwardly curved top of said first cup perimeter by different amounts;

a medial end of said inwardly curved bottom extending to a medial end of the inwardly curved top;

a curvature of the inwardly curved indentation of the fill material being different than the varying radius of curvature of the inwardly curved bottom of the first cup perimeter;

a second cup comprising:

a medial side;

a lateral side connected to the second end of the second wing;

an inner contour defining a second area and a cup volume;

an outer contour defining a volume larger than the cup volume and having a second cup perimeter;

said second cup perimeter including an inwardly curved bottom having a varying radius of curvature and an inwardly curved top having a varying radius of curvature;

said inwardly curved bottom having a middle inwardly curved portion as well as medial and lateral inwardly curved portions with greater radius of curvature than the middle inwardly curved portion and arranged on opposite sides of the middle inwardly curved portion;

a fill material extending to both the medial side and to the lateral side and being disposed between the inner contour and the outer contour; said fill material being curve-shaped and defining an area, when viewed from the rear side, that is greater than half of the second area; said fill material comprising:

an inwardly curved bottom perimeter with a varying radius of curvature;

an inwardly curved indentation disposed on an upper end of the fill material and spaced from an apex of the second cup so as to extend below the apex of the second cup; and upper lateral and medial spaced apart ends of said curve-shaped fill material spaced from and extending above the apex of the second cup and being spaced from the inwardly curved top of said second cup perimeter by different amounts;

a medial end of said inwardly curved bottom extending to a medial end of the inwardly curved top;

a curvature of the inwardly curved indentation of the fill material being different than the varying radius of curvature of the inwardly curved bottom of the second cup perimeter; and a gore having one end connected to the medial side of the first cup and an opposite end connected to the medial side of the second cup, wherein, in the unworn state, the first and second wings extend out and away from the respective first and second cups and the first and second wings are separated from one another so that the first and second closure portions extend in opposite directions.

13. The brassiere of claim 12, wherein:

said first cup perimeter further comprises a lateral side portion having a lower end extending to the inwardly curved bottom and an upper end extending to the inwardly curved top, said lateral side portion and said lateral curved portion of the inwardly curved bottom forming an L-shaped lateral edge of the first cup; and said second cup perimeter further comprises a lateral side portion having a lower end extending to the inwardly curved bottom and an upper end extending to the inwardly curved top, said lateral side portion and said lateral curved portion of the inwardly curved bottom forming an L-shaped lateral edge of the second cup.

14. The brassiere of claim 12, wherein each inner contour has an inner apex and each outer contour has an outer apex that is offset from the respective inner apex.

15. A brassiere, in an unworn state, comprising:

a first wing having a first end and a second end;

a second wing having a first end and a second end;

a first closure portion arranged on the first end of the first wing;

a second closure portion arranged on the first end of the second wing;

a first cup comprising:

a medial side;

a lateral side connected to the second end of the first wing;

an inner contour defining a first area and a cup volume;

an outer contour defining a volume larger than the cup volume and having a first cup perimeter; said first cup perimeter including an inwardly curved bottom having a varying radius of curvature, a curved lateral side portion and an inwardly curved top having a varying radius of curvature;

said inwardly curved bottom having a middle inwardly curved portion as well as medial and lateral inwardly curved portions with greater radius of curvature than the middle inwardly curved portion and arranged on opposite sides of the middle inwardly curved portion;

a fill material extending to both the medial side and to the lateral side;

said fill material having a shape defining an area, when viewed from a rear side, that is greater than half of the first area; said fill material comprising:

an inwardly curved bottom perimeter having a varying radius of curvature; and an inwardly curved indentation disposed on an upper end of the fill material between two upward projecting portions, said indentation spaced from an apex of the first cup so as to extend below the apex of the first cup;

said two upward projecting portions being spaced from and extending above the apex of the first cup and being closer to the inwardly curved top than to the inwardly curved bottom;

a width of the fill material being different on the medial side of the first cup than on the lateral side of the first cup;

a medial end of said inwardly curved bottom extending to a medial end of the inwardly curved top; and a curvature of the inwardly curved indentation of the fill material being different than the varying radius of curvature of the inwardly curved bottom of the first cup perimeter;

a second cup comprising:

a medial side;

a lateral side connected to the second end of the second wing;

an inner contour defining a second area and a cup volume;

an outer contour defining a volume larger than the cup volume and having a second cup perimeter;

said second cup perimeter including an inwardly curved bottom having a varying radius of curvature, a curved lateral side portion and an inwardly curved top having a varying radius of curvature;

said inwardly curved bottom having a middle inwardly curved portion as well as medial and lateral inwardly curved portions with greater radius of curvature than the middle inwardly curved portion and arranged on opposite sides of the middle inwardly curved portion;

a fill material extending to both the medial side and to the lateral side; said fill material having a shape defining an area, when viewed from the rear side, that is greater than half of the second area; said fill material comprising:

an inwardly curved bottom perimeter having a varying radius of curvature; and an inwardly curved indentation disposed on an upper end of the fill material between two upward projecting portions, said indentation being spaced from an apex of the second cup so as to extend below an apex of the second cup;

said two upward projecting portions being spaced from and extending above the apex of the second cup and being closer to the inwardly curved top than to the inwardly curved bottom;

a width of the fill material being different on the medial side of the second cup than on the lateral side of the second cup;

a medial end of said inwardly curved bottom extending to a medial end of the inwardly curved top; and a curvature of the inwardly curved indentation of the fill material being different than the varying radius of curvature of the inwardly curved bottom of the second cup perimeter;

a gore having one end connected to the medial side of the first cup and an opposite end connected to the medial side of the second cup;

a first strap connected to the non-circular curved top of the first cup; and a second strap connected to the non-circular curved top of the second cup, wherein, in the unworn state, the first and second wings extend out and away from the respective first and second cups and are separated from one another so that the first and second closure portions extend in opposite directions.

16. The brassiere of claim 15, wherein:

said lateral side portion of the first cup includes a lower end extending to a lateral end of the inwardly curved bottom and an upper end extending to a lateral end of the inwardly curved top, said lateral side portion and said lateral curved portion of the inwardly curved bottom forming an L-shaped lateral edge of the first cup; and said lateral side portion of the second cup includes a lower end extending to a lateral end of the inwardly curved bottom and an upper end extending to a lateral end of the inwardly curved top, said lateral side portion and said lateral curved portion of the inwardly curved bottom forming an L-shaped lateral edge of the second cup.

17. The brassiere of claim 15, wherein each inner contour has an inner apex and each outer contour has an outer apex that is offset from the respective inner apex.

18. A brassiere, in an unworn state, comprising:

a first wing having a first end and a second end;

a second wing having a first end and a second end;

a first closure portion arranged on the first end of the first wing;

a second closure portion arranged on the first end of the second wing;

a first cup comprising:

a medial side;

a lateral side connected to the second end of the first wing;

an inner contour defining a first area and a cup volume;

an outer contour defining a volume larger than the cup volume and having a first cup perimeter;

said first cup perimeter including an inwardly curved bottom having a varying radius of curvature, an inwardly curved lateral side and an inwardly curved top having a varying radius of curvature;

said inwardly curved bottom including a middle inwardly curved portion as well as medial and lateral inwardly curved portions with greater radius of curvature than the middle inwardly curved portion and arranged on opposite sides of the middle inwardly curved portion;

a fill material extending to both the medial side and to the lateral side and being disposed between the inner contour and the outer contour and spaced from the inwardly curved top by more on the lateral side than on the medial side;

said fill material having a shape defining an area, when viewed from a rear side, that is greater than half of the first area; said fill material comprising:

an inwardly curved bottom perimeter having a varying radius of curvature; and an inwardly curved indentation disposed on an upper end of the fill material; said inwardly curved indentation of the fill material being spaced from an apex of the first cup so as to extend below the apex of the first cup, a second cup comprising:

a medial side;

a lateral side connected to the second end of the second wing;

an inner contour defining a second area and a cup volume;

an outer contour defining a volume larger than the cup volume and having a second cup perimeter;

said second cup perimeter including an inwardly curved bottom having a varying radius of curvature, an inwardly curved lateral side and an inwardly curved top having a varying radius of curvature;

said inwardly curved bottom including a middle inwardly curved portion as well as medial and lateral inwardly curved portions with greater radius of curvature than the middle inwardly curved portion and arranged on opposite sides of the middle inwardly curved portion;

a fill material extending to both the medial side and to the lateral side and being disposed between the inner contour and the outer contour and spaced from the inwardly curved top by more on the lateral side than on the medial side;

said fill material having a shape defining an area, when viewed from the rear side, that is greater than half of the second area; said fill material comprising:

an inwardly curved bottom perimeter having a varying radius of curvature; and an inwardly curved indentation disposed on an upper end of the fill material; said inwardly curved indentation of the fill material being spaced from an apex of the second cup so as to extend below the apex of the second cup, wherein, in the unworn state, the first and second wings extend out and away from the respective first and second cups and are separated from one another so that the first and second closure portions extend in opposite directions.

19. The brassiere of claim 18, wherein:

a thickness of the fill material is different on the medial side of the first cup than on the lateral side of the first cup;

a thickness of the fill material is different on the medial side of the second cup than on the lateral side of the second cup.

* * * * *